US007424463B1

(12) United States Patent
Napoletani et al.

(10) Patent No.: US 7,424,463 B1
(45) Date of Patent: Sep. 9, 2008

(54) DENOISING MECHANISM FOR SPEECH SIGNALS USING EMBEDDED THRESHOLDS AND AN ANALYSIS DICTIONARY

(75) Inventors: Domenico Napoletani, Fairfax, VA (US); Carlos A. Berenstein, Bethesda, MD (US); Timothy Sauer, Fairfax, VA (US); Daniele C. Struppa, Fairfax, VA (US); David Walnut, Fairfax, VA (US)

(73) Assignees: George Mason Intellectual Properties, Inc., Fairfax, VA (US); University of Maryland, College Park, MD (US)

( * ) Notice: Subject to any disclaimer, the term of this patent is extended or adjusted under 35 U.S.C. 154(b) by 217 days.

(21) Appl. No.: 11/106,669

(22) Filed: Apr. 15, 2005

Related U.S. Application Data

(60) Provisional application No. 60/578,355, filed on Jun. 10, 2004, provisional application No. 60/562,534, filed on Apr. 16, 2004.

(51) Int. Cl.
*G06E 1/00* (2006.01)
*G06E 3/00* (2006.01)

(52) U.S. Cl. ..... 706/20

(58) Field of Classification Search ..... 702/189, 702/224, 181; 704/209; 705/400; 706/20
See application file for complete search history.

(56) References Cited

U.S. PATENT DOCUMENTS 5,781,144 A * 7/1998 Hwa ..... 342/13
2004/0071363 A1* 4/2004 Kouri et al. ..... 382/276

* cited by examiner

*Primary Examiner*—David Vincent
*Assistant Examiner*—Kalpana Bharadwaj
(74) *Attorney, Agent, or Firm*—David Grossman; David Yee

(57) ABSTRACT

A denoising mechanism uses chosen signal classes and selected analysis dictionaries. The chosen signal class includes a collection of signals. The analysis dictionaries describe signals. The embedding threshold value is initially determined for a training set of signals in the chosen signal class. The update signal is initialized with a signal corrupted by noise. The estimate calculated by: computing coefficients for the updated signal using the analysis dictionaries; computing an embedding index for each of the path(s); extracting a coefficient subset from coefficients for the path(s) whose embedding index exceeds an embedding threshold; adding a coefficient subset to a coefficient collection; generating a partial estimate using the coefficient collection; creating an attenuated partial estimate by attenuating the partial estimate by an attenuation factor; updating the updated signal by subtracting the attenuated partial estimate from the updated signal; and adding the attenuated partial estimate to the estimate.

18 Claims, 26 Drawing Sheets

DENOISING MECHANISM FOR SPEECH SIGNALS USING EMBEDDED THRESHOLDS AND AN ANALYSIS DICTIONARY

CROSS-REFERENCE TO RELATED APPLICATIONS

The present application claims the benefit of provisional patent applications: Ser. No. 60/562,534 to Napoletani et al., entitled "Denoising of Speech Signals through Embedding Threshold," filed on Apr. 16, 2004, which are hereby incorporated by reference; and Ser. No. 60/578,355 to Napoletani et al., entitled "Denoising of Speech Signals through Embedding Threshold," filed on Jun. 10, 2004; which are hereby incorporated by reference.

BRIEF DESCRIPTION OF THE SEVERAL VIEWS OF THE DRAWINGS

The accompanying drawings, which are incorporated in and form a part of the specification, illustrate an embodiment of the present invention and, together with the description, serve to explain the principles of the invention.

DETAILED DESCRIPTION OF THE INVENTION

Figure 1:
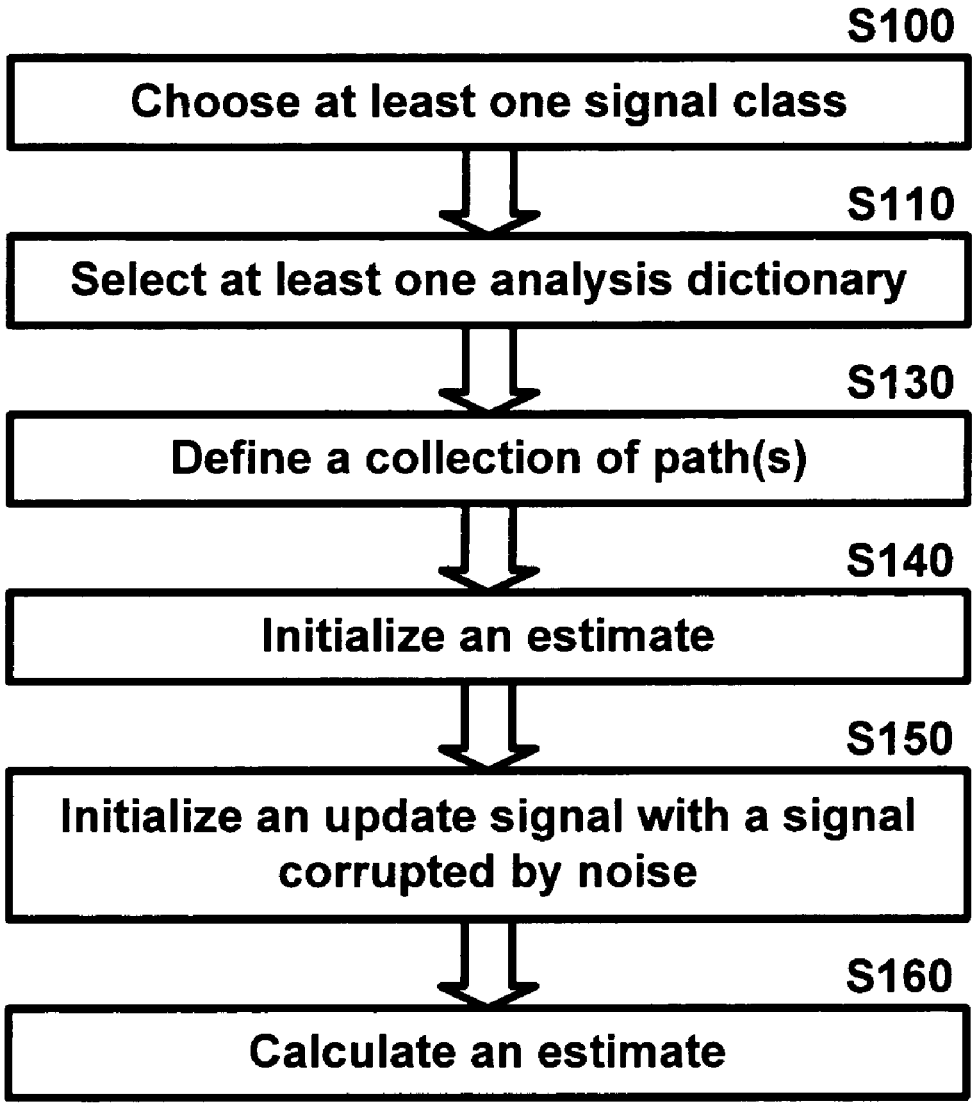
FIG. 1 is flow diagram of a denoising mechanism as per an aspect of an embodiment of the present invention.
Figure 2:
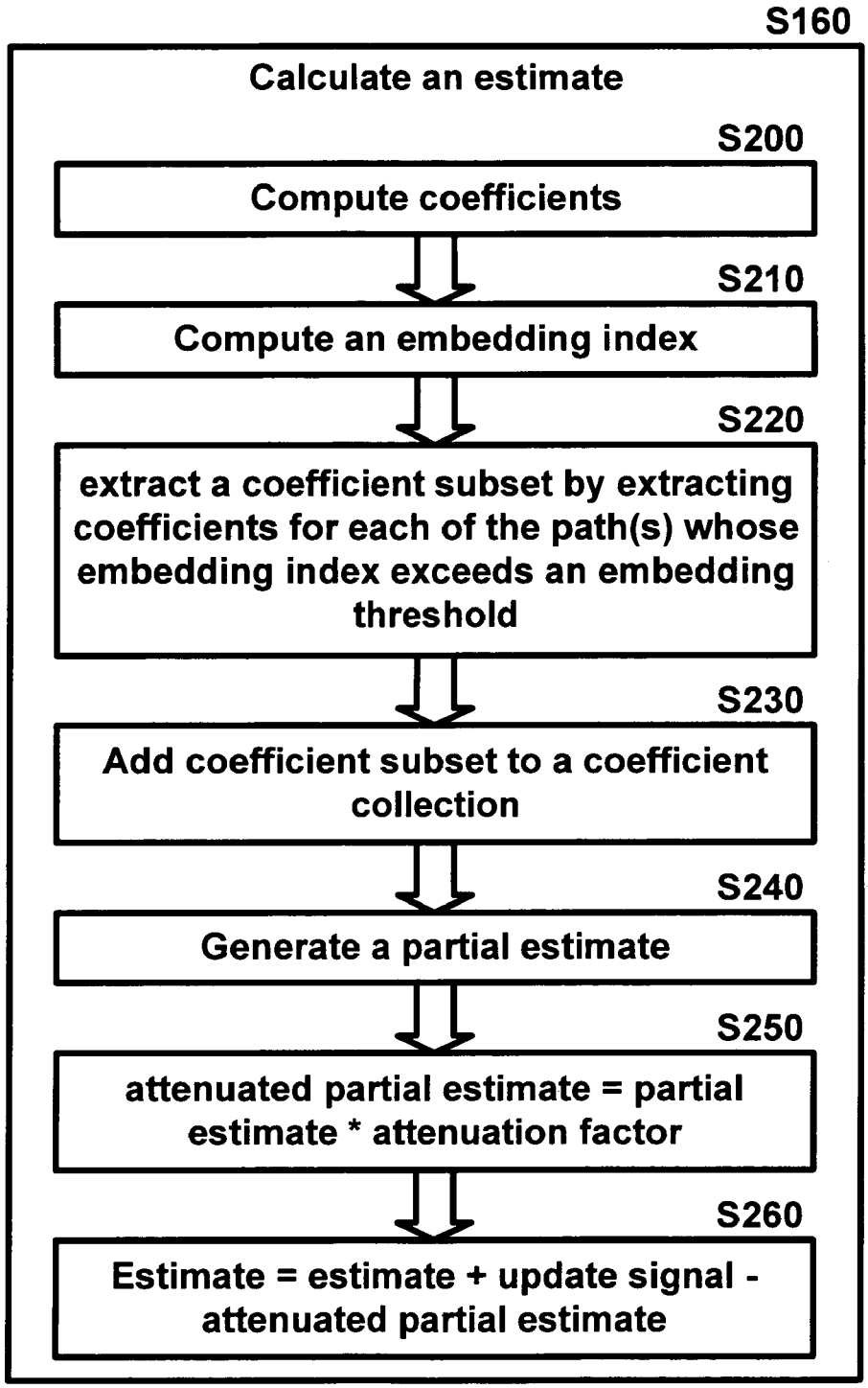
FIG. 2 is a flow diagram of an estimate calculation as per an aspect of an embodiment of the present invention.

The present invention as embodied and broadly described herein, is a denoising mechanism that may be embodied in a computer program. An embodiment of this program is shown in FIG. 1. The denoising program, using at least one chosen signal class (chosen at step S100) and at least one selected analysis dictionary selected at step S110), defines at least one collection of paths in at least one of the analysis dictionaries (S130) and then calculates an estimate (S130). The chosen signal class may include a collection of signals. The analysis dictionary is preferably capable of being used to describe signals. At the outset, the estimate and an update signal are initialized at steps S140 and S150 respectively. The update signal should be initialized with a signal corrupted by noise as shown in step S150. The estimate may them be calculated through an iterative process at step S160. The iterative process may include: computing coefficients for the updated signal using at least one of the analysis dictionaries (S200); computing an embedding index for each of the path(s) (S210); extracting a coefficient subset from coefficients for at least one of the path(s) whose embedding index exceeds an embedding threshold (S220); adding a coefficient subset to a coefficient collection (S230); generating a partial estimate using the coefficient collection (S240); creating an attenuated partial estimate by attenuating the partial estimate by an attenuation factor (S250); updating the updated signal by subtracting the attenuated partial estimate from the updated signal; and adding the attenuated partial estimate to the estimate (S260).

In a preferred embodiment, the signal class is a speech signal class. However, one skilled in the art will recognize that other signal classes, such as a transducer signal class or an image signal class, may be used. At least one of the analysis dictionaries may be a windowed Fourier frame (especially when the signal class is a signal class such as a speech signal class). In this case, at least one collection of paths may be a set of short lines oriented in time direction in the windowed Fourier frame.

Figure 3:
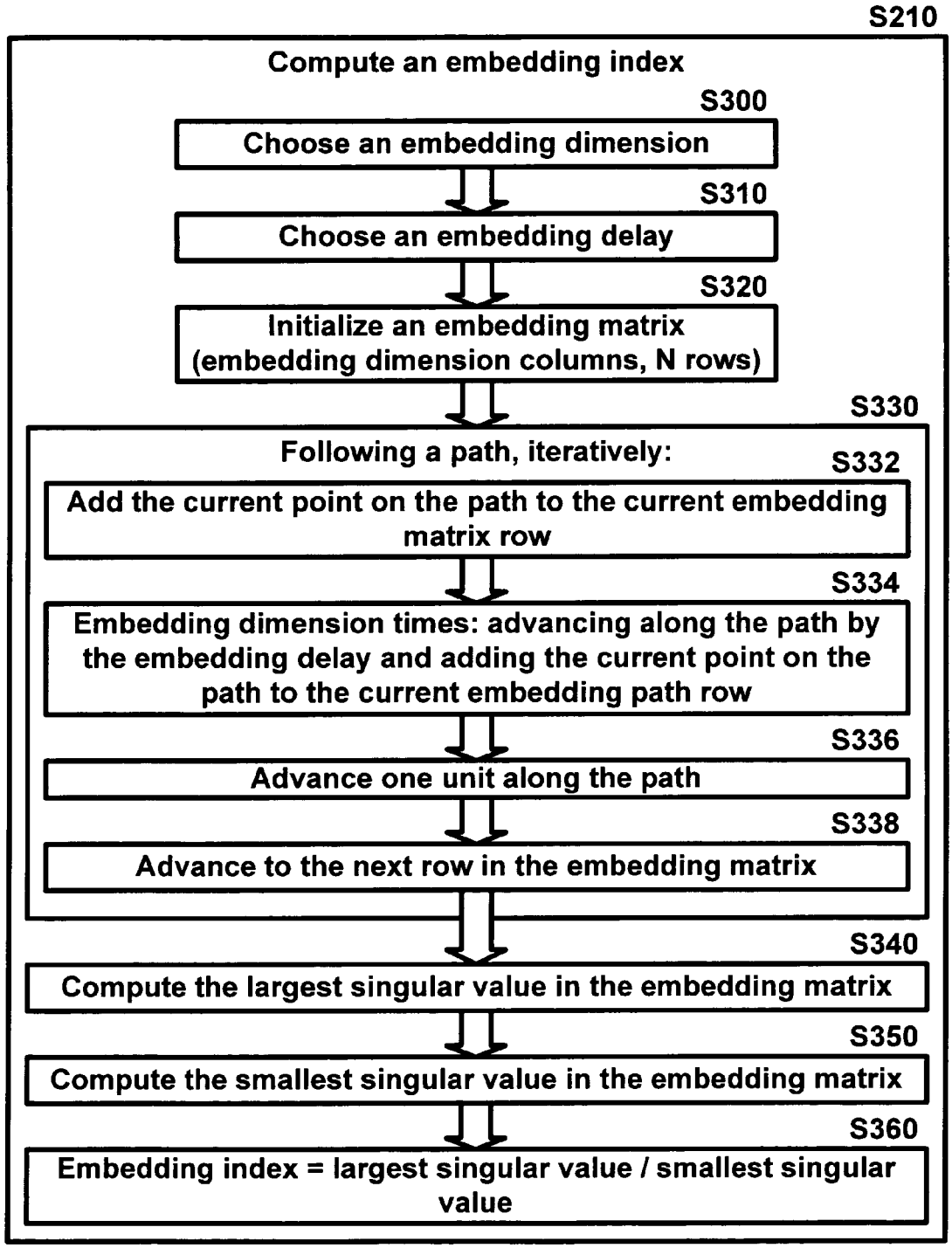
FIG. 3 is a flow diagram of an embedding index calculation as per an aspect of an embodiment of the present invention.

FIG. 3 expands upon step S210 and shows how the embedding index may be computed for paths by: choosing an embedding dimension (S300); choosing an embedding delay (S310); initializing an embedding matrix (S320), (where the embedding matrix has embedding dimension columns and a multitude of rows); and then from the beginning of a path to the end of a path performing an iterative process (S330). The iterative process S330 may include: adding the current point on the path to the current embedding matrix row (S332); embedding dimension times: advancing along the path by the embedding delay and adding the current point on the path to the current embedding matrix row (S334); advancing one unit along the path (S336); and advancing to the next row in the embedding matrix (S338); computing the largest singular value of the embedding matrix (S340); computing the smallest singular value of the embedding matrix (S350); and finally, computing the embedding index as the quotient of the largest singular value and the smallest singular value (S360).

Figure 4:
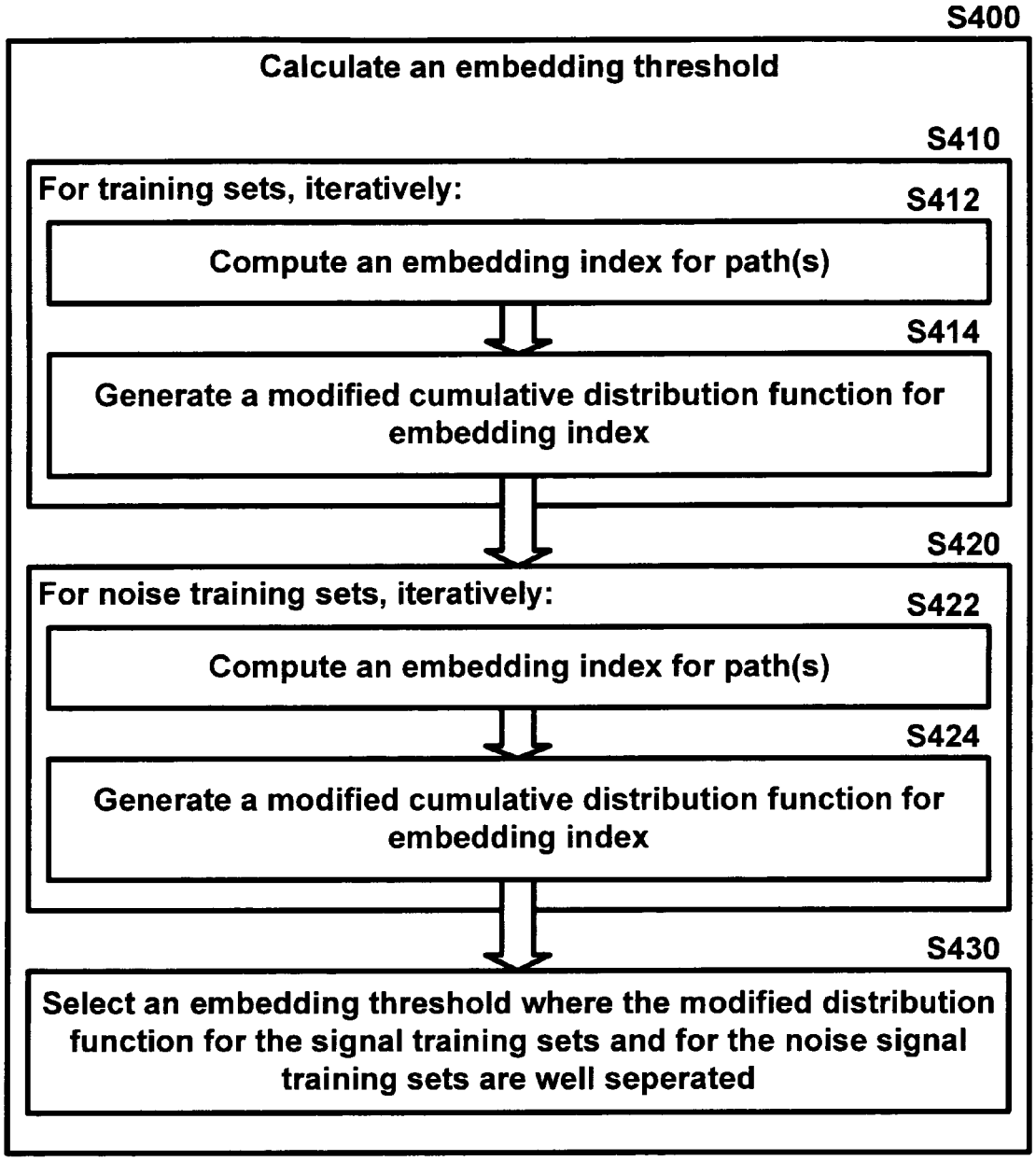
FIG. 4 is a flow diagram of an embedding threshold calculation as per an aspect of an embodiment of the present invention.

FIG. 4 shows how the embedding threshold may be calculated (S400) by: for each of a multitude of signal training sets; iteratively (S412): computing the embedding index for each path in at least one collection of paths (S412); and generating a modified cumulative distribution function for the embedding index for each of the at least one collection of paths (S414); for each of a multitude of noise signal training sets; iteratively (S420): computing the embedding index for each path in the collection of paths (S422); and generating a modified cumulative distribution function for the embedding index for each of the paths (S424); and selecting the embedding threshold where the modified cumulative distribution function for the multitude of signal training sets and for the multitude of noise signal training sets are well separated (S430).

The modified cumulative distribution function may take on several forms such as an index cumulative function, or a cumulative distribution function that gives the probability that the embedding index has a value larger than or equal to a given value.

The embedding index may be a combination of the embedding index and a distance of the embedding matrix from an origin.

The signal class may be chosen prior to the encoding of the computer program and then included with the computer program. Similarly, the analysis dictionary may be selected prior to the encoding of the computer program and included with the computer program. The collection of path(s) may also be defined prior to the encoding of said computer program; and included with the computer program.

Figure 5:
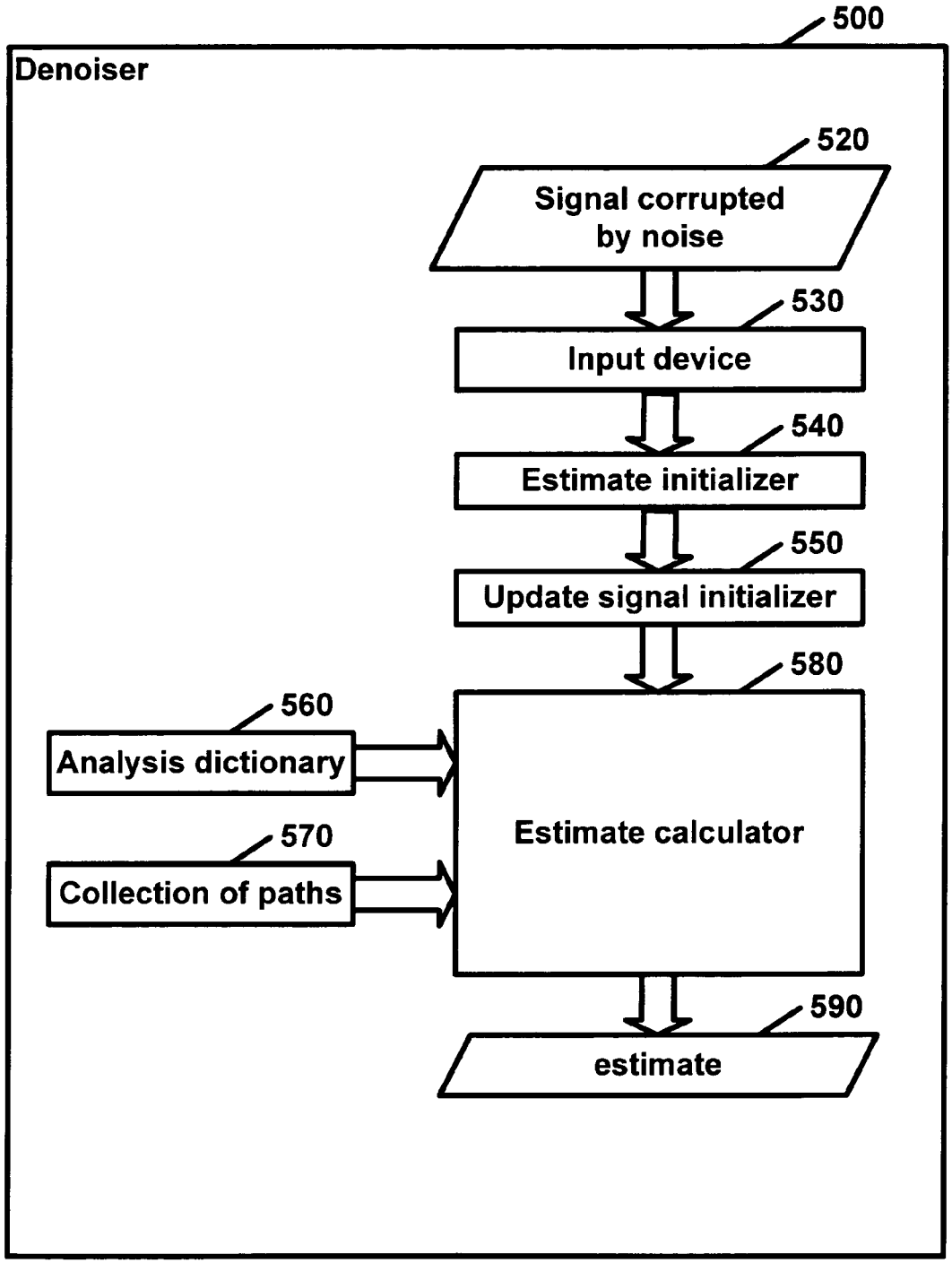
FIG. 5 is a block diagram of a denoiser as per an aspect of an embodiment of the present invention.

Alternatively, the present invention may be embodied as an apparatus as shown in FIG. 5. This denoising apparatus 500 may include an input device 530, at least one analysis dictionary 560, at least one collection of paths 570, an estimate initializer 540, an update signal initializer 550, and an estimate calculator 580. The input device 530 is preferably configured to receive a signal corrupted by noise 520, where the signal is a member of a signal class. The signal class may include a collection of signals. Analysis dictionaries are preferably capable of being used to describe the collection of signals. At least one collection of paths in at least one of the analysis dictionaries should be suitable for the signal class. Each of the collection of paths preferably includes at least one path.

The estimate initializer 540 should be configured to initialize an estimate 590 and the update signal initializer 550 should be configured to initialize an update signal with the signal that is corrupted by noise 520.

The estimate calculator 580 should be configured to calculate an estimate 590 by iteratively: computing coefficients for the updated signal using one of the analysis dictionaries 560; computing an embedding index for each of the path(s); extracting a coefficient subset from the coefficients for path(s) whose embedding index exceeds an embedding threshold; adding the coefficient subset to a coefficient collection; generating a partial estimate using the coefficient collection; creating an attenuated partial estimate by attenuating the partial estimate by an attenuation factor; updating the updated signal by subtracting the attenuated partial estimate from the updated signal; and adding the attenuated partial estimate to the estimate.

This invention utilizes techniques from the theory of non-linear dynamical systems to define a notion of embedding threshold estimators. More specifically, the present invention uses delay-coordinates embeddings of sets of coefficients of the measured signal (in some chosen frame) as a data mining tool to separate structures that are likely to be generated by signals belonging to some predetermined data set. Described is a particular variation of the embedding threshold estimator implemented in a windowed Fourier frame applied to speech signals heavily corrupted with the addition of several types of white noise. Experimental work suggests that, after training on the data sets of interest, these estimators perform well for a variety of white noise processes and noise intensity levels. This method is compared, for the case of Gaussian white noise, to a block thresholding estimator.

As described, the present invention includes a denoising technique that is designed to be efficient for a variety of white noise contaminations and noise intensities. The method is based on a loose distinction between the geometry of delay-coordinates embeddings of, respectively, deterministic time series and non-deterministic ones. Delay-coordinates embeddings are the basis of many applications of the theory of non-linear dynamical systems. The present invention stands apart from previous applications of embeddings in that no exact modelization of the underlining signals (though the delay-coordinates embeddings) is needed. Instead, the present invention measures the overall 'squeezing' of the dynamics along the principal direction of the embedding image by computing the quotient of the largest and smallest singular values.

First, the context in which signal estimators may be looked for is defined. Let F[n], n=1, . . . , N, be a discrete signal of length N, and let X[n]=F[n]+W[n], n=1, . . . , N, be a contaminated measurement of F[n], where W[n] are realizations of a white noise process W. Throughout this disclosure, the notation E(*) is used to denote the expected value of a quantity *.

Generally, the present invention is interested in estimators F such that the expected mean square error $E\{|f-F|^2\}$ is as small as possible. For a given discrete orthonormal basis $B=\{g_m\}$ of the N dimensional space of discrete signals, one can write:

$$X = \sum_{m=0}^{N-1} X_B[m] g_m$$

where $X_B[m]=\langle X, g_m\rangle$ is the inner product of X and $g_m$. Given such notation, a class of estimators may be defined that is amenable to theoretical analysis, namely the class of diagonal estimators of the form $$\tilde{F} = \sum_{m=0}^{N-1} d_m(X_B[m]) g_m$$

where $d_m(X_B[m])$ is a function that depends only on the value of $X_B[m]$. One particular kind of diagonal estimator is the hard thresholding estimator $\tilde{F}_T$ (for T some positive real number) defined by the choice $$\tilde{F}_T = \sum_{m=0}^{N-1} d_m(X_B[m])g_m \text{ where} \tag{1}$$

$$d_m(X_B[m]) = X_B[m] \text{ if } |X_B[m]| > T \text{ and}$$

$$d_m(X_B[m]) = 0 \text{ otherwise.}$$

If W[n] are realizations of a white normal distribution with variance $\sigma^2$, then it is shown in [DJ] that $\tilde{F}_T$, with $T=\sigma\sqrt{2\log N}$, achieves almost minimax risk (when implemented in a wavelet basis) for the class of signals f[n] of bounded variation. The possibility of proving such a striking result is based, in part, on the fact that the coefficients $W_B[n]$ are realizations of a Gaussian white noise process in any basis B.

Several techniques have been developed to deal with the non-Gaussian case, some of the most successful are the Efromovich-Pinsker (EP) estimator (see for example [ELPT] and references therein) and the block threshold estimators of Cai and collaborators (see [CS], [C] and the more recent [CL]). In these methods, the variance of the white process needs to be estimated from the data, moreover, since the threshold is designed to evaluate intensities (or relative intensities) of the coefficients in blocks of multiwavelets, low intensity details may be filtered out as it is the case for simpler denoising methods (see also remark 3 on the issue of low intensity non-noisy features).

The method as per the present invention may be practiced without the knowledge of the noise intensity level (thanks to the use of quotients of singular values), and may be remarkably robust to changes in the type of noise distribution.

This strength is achieved at a price, the inner parameters of the algorithm may need to be adjusted to the data, this is true to some extent for the EP and block thresholding algorithms as well (see again [ELPT] and [CL]), but the number and type of parameters that need to be trained in our approach is increased by the need of choosing 'good' delay-coordinates embedding suitable for the data we would like to denoise. However, training on the data sets, such as speech signals, may be automated.

Because of the choice of applying the present invention to a database of speech signals, windowed Fourier frames may be used as a basic analytical tool.

Note that any discrete periodic signal X[n], $n\in\mathbb{Z}$ with period N can be represented in a discrete windowed Fourier frame. The atoms in this frame are of the form $$g_{m,l}[n] = g[n-m]\exp\left(-\frac{i2\pi ln}{N}\right),\ n \in \mathbb{Z}. \tag{2}$$

The window g may be chosen to be a symmetric N-periodic function of norm 1 and support q. Specifically, g may be chosen to be the characteristic function of the [0,1] interval. Although this may not be the most robust choice in many cases, selecting this function preferably avoids excessive smoothing which could affect possible embodiments of the present invention.

Under the previous conditions x can be completely reconstructed from the inner products $\mathcal{F}[m,l]=\langle X,g_{m,l}\rangle$, i.e., $$X = \frac{1}{N}\sum_{m=0}^{N-1}\sum_{l=0}^{N-1}\mathcal{F}X[m,l]\tilde{g}_{m,l} \tag{3}$$

where $$\tilde{g}_{m,l}[n] = g[n-m]\exp\left(\frac{i2\pi ln}{N}\right),\ n\in\mathbb{Z} \tag{4}$$

We denote the collection $\{\langle X,g_{m,l}\rangle\}$ by $\mathcal{F}X$. For finite discrete signals of length N the reconstruction may have boundary errors. However, the region affected by such boundary effects is limited by the size q of the support of g and we can therefore have perfect reconstruction if we first extend X suitably at the boundaries of its support and then compute the inner products $\mathcal{F}X$. More details may be found in [S] and references therein.

Since for speech signals much of the structure is contained in 'ridges' in the time frequency domain that are oriented in time direction, the collection $C_p$ of double-indexed paths $$\gamma_{\overline{m},\overline{l}}=\{g_{m,l} \text{ such that } l=\overline{l}, \overline{m}\leqq m\leqq\overline{m}+p\} \tag{5}$$

where p is some positive integer, will be relatively sensitive to local time changes of such ridges, since each path is a short line in the time frequency domain oriented in the time direction.

The choice of p is very important as different structure in speech signals (the type of signal being used to describe the present embodiment of the present invention) is evident at different time scales. Let $I=I(\gamma_{\overline{m},\overline{l}})=I(\mathcal{F}X_{\gamma_{\overline{m},\overline{l}}})$ be a function defined for each path $\gamma_{\overline{m},\overline{l}}\in C_p$. Now, a semi-local threshold estimator in the window Fourier frame may be defined as follows:

$$\tilde{F} = \frac{1}{N}\sum_{m=0}^{N-1}\sum_{l=0}^{N-1} d_{l,T}(\mathcal{F}X[m,l])\tilde{g}_{m,l} \tag{6}$$

where $d_{l,T}(\mathcal{F}X[m,l])=\mathcal{F}X[m,l]$ if $I)\mathcal{F}X_{\gamma_{\overline{m},\overline{l}}})\geqq T$ for some $\gamma_{\overline{m},\overline{l}}$ containing (m,l), and $d_{l,T}(\mathcal{F}X[m,l])=0$ if $I(\mathcal{F}X_{\gamma_{\overline{m},\overline{l}}})<T$ for all $\gamma_{\overline{m},\overline{l}}$ containing (m,l).

Note that this threshold estimator is build to mirror the diagonal estimators in (1), but that the 'semilocal' quality of $\tilde{F}$ is evident from the fact that all coefficients in several $\mathcal{F}X_\gamma$ are used to decide the action of the threshold on each coefficient. This procedure is similar to block threshold estimators, with the additional flexibility of choosing the index function I. The next section describes how the present invention uses novel embedding techniques from non-linear dynamical systems theory to choose a specific form for I. This way a variance independent estimator may be found that does not depend significantly on the probability distribution of the random variable W and such that can be adapted to data in a flexible way.

Delay-Coordinates Embedding Images of Time Series

A fundamental result about reconstruction of the state space realization of a dynamical system from its time series measurements is recalled. Suppose S is a dynamical system, with state space $\mathbb{R}^k$ and let $h: \mathbb{R}^k \to \mathbb{R}$ be a measurement, i.e., a continuous function of the state variables. Define moreover a function F of the state variables X as $$F(X)=[h(X), h(S_{-\tau}(X)), \ldots, h(S_{-(d-1)\tau}(X))] \quad (7)$$

where by $S_{-j\tau}(X)$, the state of the system may be denoted with initial condition X at $j\tau$ time units earlier.

$A \subset \mathbb{R}^k$ may be an invariant set with respect to S if $X \in A$ implies $S_t(X) \in A$ for all t. Then the following theorem is true (see [ASY], [SYC] and [KS]):

Theorem: Let A be an m-dimensional submanifold of $\mathbb{R}^k$ which is invariant under the dynamical system S. If d>2m, then for generic measuring functions h and generic delays $\tau$, the function F defined in (7) is one-to-one on A.

Keeping in mind that generally the most significant information about g is the knowledge of the attractive invariant subsets, it may be said that delay maps allow a faithful description of the underlining finite dimensional dynamics, if any. The previous theorem can be extended to invariant sets A that are not topological manifolds; in which case, more sophisticated notions of dimension may be used (see [SYC]).

Generally, the identification of the 'best' $\tau$ and d that allows for a faithful representation of the invariant subset may be considered very important in practical applications (as discussed in depth in [KS]), as it allows properties of the invariant set itself to be made transparent. More particularly, the dimension m of the invariant set (if any) may be deduced from the data itself so that a d may be chosen that is large enough for the theorem to apply. Moreover, the size of $\tau$ should be large enough to resolve an image far from the diagonal, but small enough to avoid decorrelation of the delay coordinates point.

The structure of the embedding may be applied in such a way that it is not so crucial to the identification of the most suitable $\tau$ and d, even though parameters may need to be trained on available data, but in a much simpler and straightforward way. The technical reason for such robustness in the choice of parameters will be clarified later on, but essentially time delay embeddings may be used as data mining tools rather than modelization tools as usually is the case.

To understand how such data mining is possible, the delay-coordinate procedure may be applied to the time series W[n], n=1, . . . , N, for W an uncorrelated random process; let the measuring function h be the identity function and assume from now on that $\tau$ is an integer delay so that $F(W[n])=[W[n], W[n-\tau], \ldots, W[n-(d-1)\tau]]$. For any embedding dimension d, the state space may be filled according to a spherically symmetric probability distribution. Then, the following very simple but fertile lemma may be had that relates spherical distributions to their associated to principal directions Lemma 1: Let $\overline{W}=\{F(W[n]), n=1, \ldots, N\}$ be the embedding image of W in $\mathbb{R}^d$ for any given time delay $\tau$, let moreover $\sigma_1$, $\sigma_d$ be the variance of W along the first principal direction (of largest extent) and the last one (smallest) respectively. Then the expected value $$E\left\{\frac{\sigma_1}{\sigma_d}\right\}$$

converges to 1 as N goes to infinity.

Proof: Because W is a white noise process, each coordinate of F(W[n]) is a realization of a same random variable with some given probability density function g, therefore $\overline{W}$ is a realization of a multivariate random variable of dimension d and symmetric probability distribution. If the expected value of $$\frac{\sigma_1}{\sigma_d} = d_1 > 1,$$

then a point at a distance from the origin of $\tau_1$ has a greater probability to lie along the principal direction associated to $\tau_1$ contradicting the fact that the probability distribution of $\overline{W}$ was symmetric.

Remark 1: Even when X is a pure white noise process, the windowed Fourier frame will enforce a certain degree of smoothness along each path $\gamma$ since consecutive points in $\gamma$ are inner products of frame atoms with partially overlapping segments of X. So there will be some correlation in $\mathcal{F}X_\gamma$ even when X is an uncorrelated time series, therefore it is possible in general that $I(\mathcal{F}X_\gamma)>>1$ even when X is a white noise process.

Remark 2: Similarly, the length p of $\gamma$ cannot be chosen very large in practice, while $$E\left(\frac{\sigma_1}{\sigma_d}\right)$$

converges to 1 for any uncorrelated processes only asymptotically for very long time series and again for small length p, we may have $$E\left(\frac{\sigma_1}{\sigma_d}\right) >> 1.$$

Even with the limitations explained in the previous two remarks, it is still meaningful to set $$I(X_\gamma) = I^{svd}(X_\gamma) = \frac{\sigma_1}{\sigma_d},$$

and therefore define an embedding threshold estimator to be a semilocal estimator $\mathbb{F}$ (as in (2)) with the choice of index $I=I^{svd}$, what may be called an embedding index. The question is now to find a specific choice of $T \geqq 1$, given a choice of (D, $C_p$, d, $\tau$), that allows to discriminate a given data set (such as speech signals) from white noise processes.

Therefore, it is advantageous to study the value distribution of $I^{svd}$ for the specific choice of $C_p$ and D, and assuming X is either an uncorrelated random process or a signal belonging to the class of speech signals.

In the next section, this issue is explored numerically for an embodiments which uses windowed Fourier frames and the collection of paths $C_p$ in (5).

Embedding Index of Speech Signals and Random Processes

For a given times series X and choice of parameters (p, $\tau$, d), the collection of embedding indexes $I^{svd}(\mathcal{F}X)=\{I^{svd}(\mathcal{F}X_\gamma), \gamma \in C_p\}$ may be computed. The index cumulative function may now be defined as:

$$Q_X(t) = \frac{\#\{\gamma such that I^{svd}(\mathcal{F}\ X_\gamma) > t\}}{\#\{\gamma\}}, \tag{8}$$

i.e. for a given t, $Q_X(t)$ is the fraction of paths that have index above t.

A simple property of $Q_X$ may be crucial in the following discussion:

Lemma 2: If X is a white noise process and X'=aX is another random process that component by component is a resealing of X by a positive number a, then the expected function $Q_X$ and $Q_{X'}$ are equal.

Proof: Each set of embedding points generated by one specific path γ is, coordinate by coordinate, a linear combination of some set of points in the original time series. Therefore, if X'=aX, $\overline{X}_\gamma'=a\overline{X}_\gamma$, but the quotient of singular values of a set of points is not affected by rescaling of all coordinates. Therefore, the distributions of $I^{svd}(\mathcal{F}X)$ and $I^{svd}(\mathcal{F}X')$ are equal, but $Q_X$ and $Q_{X'}$ are defined in terms of $I^{svd}$ so they are equal as well.

Remark 3: It can be seen that the use of an embedding index as a possible generalization of methods like the coherent structures extraction of [M] section 10.5 (more details can be found in [DMA]), where it is explored the notion of correlation of a signal X with a basis B, defined as:

$$C(X) = \frac{sup_{0\le m\le N}|X_B[m]|}{|X|}.$$

It turns out that in the limit N→∞ the correlation of any Gaussian white process converges to $$C_N = \frac{\sqrt{2\log_e N}}{\sqrt{N}}$$

independently of the specific variance and therefore estimation of a signal X is performed by retaining a coefficient $X_B[m]$ if $$\frac{|X_B[m]|}{|X|} > C_N.$$

The embedding index determines the coherence of a coefficient with respect to a neighborhood of the signal and it is independent of the variance of the noise process as well.

Remark 4: The choice of p in $C_p$ is very important in practice. For the current example, the speech signals considered were sampled at a sampling frequency of about 8100 pt/s. Values $l_1$=64 and p=$2^8$ were chosen since these values imply that each path will be significantly shorter than most stationary vocal emissions, a point to take into consideration when we gauge the relevance of our results.

Given this length p for γ, there may be some significant restrictions on the maximum embedding dimension d and time delay τ that can be chosen to have each path have a sufficiently large number of points in the embedding image to be statistically significant. This may be obtained if p>>dτ.

Because of these restrictions, d=4 and τ=4 may be chosen to give dτ=$2^4$<<p=$2^8$. In this way, 240 points for each path may be generated. It is heuristically possible to try and adjust the embedding parameters d and τ and the length p of the paths so that the qualitative behavior of speech signals and white noise processes is as distinct as possible. Possible ways to make the choice of parameters automatic is discussed later.

Some uncorrelated zero mean random processes of length N=$2^{11}$ on the windowed Fourier frame with the set values $l_1$=64, p=$2^8$, d=4 and τ=8 may now be expanded. The embedding index $Q_X$ may now be calculated.

The specific random processes used here are time series with each point a realization of a random variables with:

1) Gaussian probability density function;
2) Uniform probability density function;
3) Tukey probability density function, that is, a sum of two normal distributions with uneven weight (used in [ELPT] as well), each point of the time series is a realization of the random variable $W=RN_1+(1-R)4N_2/\sqrt{r+16(1-r)}$, where $N_1$ and $N_2$ are Gaussian random variables, and R is a Bernoulli random variable with P(R=1)=r=0.9; and
4) discrete uniform pdf with values in {−Q,Q} for some positive Q.

All probability density functions may be set to have mean zero and variance 1, since by Lemma 2 it may be known that $Q_*$ will not be affected by changes of the variance. One of the pdf has heavy tail (Tukey pdf) and one of them is discrete (discrete uniform pdf). The kurtosis is respectively from pdf in 1) to pdf in 4): 3, about 1.8, about 13, and about 1.2

Figure 6A:
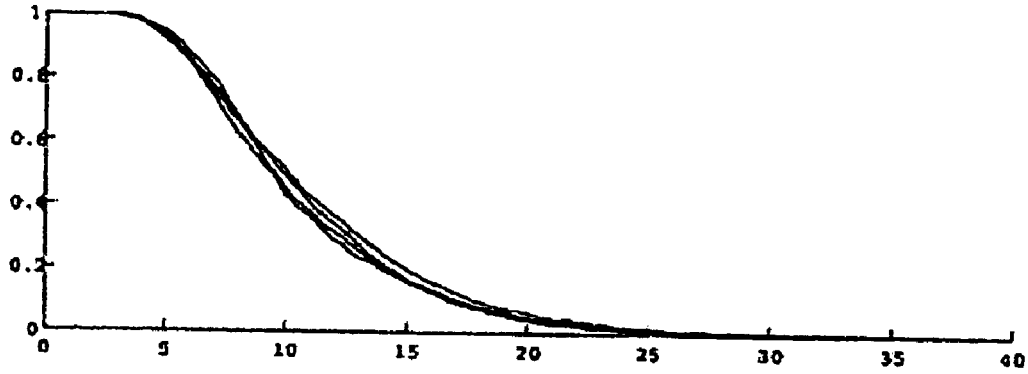
FIG. 6 shows $Q_*$, as defined in equation (7) for: a uncorrelated random processes; and ten randomly selected segments of a speech signal.

FIG. 6*a* is a plot of $Q_X(t)$ for the white noise processes generated with pdfs in 1)-4), averaged over 10 repetitions for each random distribution. From top to bottom, FIG. 6 shows $Q_*$, as defined in equation (7) for: a) uncorrelated random processes 1) to 4); and b) ten randomly selected segment of speech signal from the TIMIT database.

Remark 5: To speed up the computation, the length of the sampling of the paths' indexes $(\overline{m},\overline{l})$ was chosen to be $S_{\overline{m}}$=1 and $S_{\overline{l}}$=p.

Note that the qualitative behavior of $Q_X$ is very similar for all chosen distributions. In particular, they all exhibit a very fast decay for larger values of t. The maximum $L_2$ distance between any two $Q_X$ in the interval [0,40] is ≈0.54 (or some 6% of the average $L_2$ norm of the $Q_X$), it was found that even for distribution with kurtosis up to 50, the maximum distance was less that 0.8 (about 8.5% of the average $L_2$ norm of $Q_X$), irrespective of the specific pdf. Moreover, most of the error is concentrated in regions of high intensity of the derivative and it does not affect much the behavior of the right tail of the curves $Q_X$.

Therefore, it seems that for our choice of D and $C_p$, reasonably heavy tail distributions will not exhibit a significantly different behavior in $Q_X$ with respect to the Gaussian distribution. This supports the claim that $Q_X$ is robust with respect to the choice of white noise distribution.

For each probability density function, the shape of $Q_X$ is affected by the correlation introduced by the length of $l_1$ (the window support of the windowed Fourier Frame): if τ<$l_1$, some coordinates in each embedding point will be correlated and this will cause the decay of $Q_X$ to be slower as τ goes to 1.

Figure 6B:
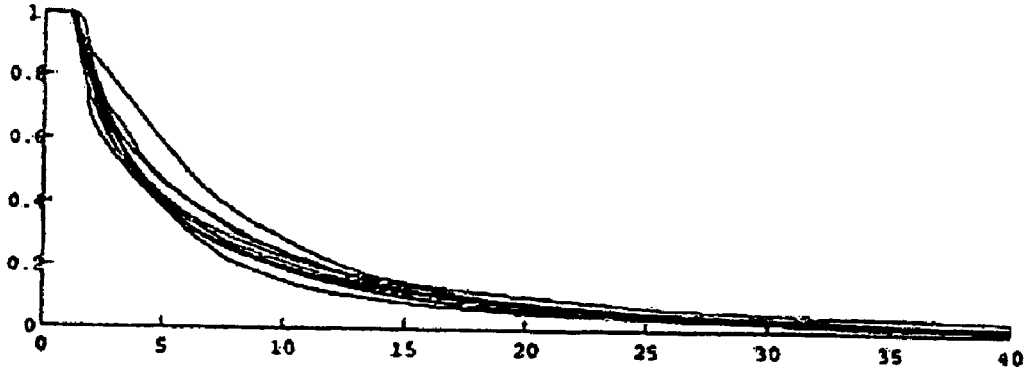

When $Q_X$ is computed (with the same choice of parameters) for a collection of 10 randomly selected segments of speech signals of length $2^{11}$, the rate of decay of the functions $Q_X$ is significantly different, and the tail of the functions is still considerably thick by the time the rate of decay of $Q_X$ for most random processes is almost zero (see FIG. 6*b*).

Since it is desirable to have a significantly larger fraction of paths retained for speech signals rather than noise, the threshold T may be selected in the following way:

Determination of Threshold Given a choice of parameters (D, $C_p$, p, τ, d), a collection of training speech time series $\{S_j\}$, and a selection of white noise processes $\{W_i\}$, choose $T_0$ be the smallest t so that the mean of $Q_{S_j}(T_0)$ is one order of magnitude (10 times) larger than the mean of $Q_{W_i}(T_0)$.

This heuristic rule gives, for the parameters in this section, $T_0 \approx 28.2$. (A) gives an experimental way to determine a threshold $T=T_0$ for the index $I^{svd}$ that removes most of the time frequency structure of some predetermined noise distributions, while it preserves a larger fraction of the time frequency structure of speech signals. Since moreover 'reasonable' distributions exhibited a $Q_X$ similar to the one of Gaussian distributions, in practice the threshold may be trained only on Gaussian noise and be assured that it will be a meaningful value for a larger class of distributions.

Figure 7:
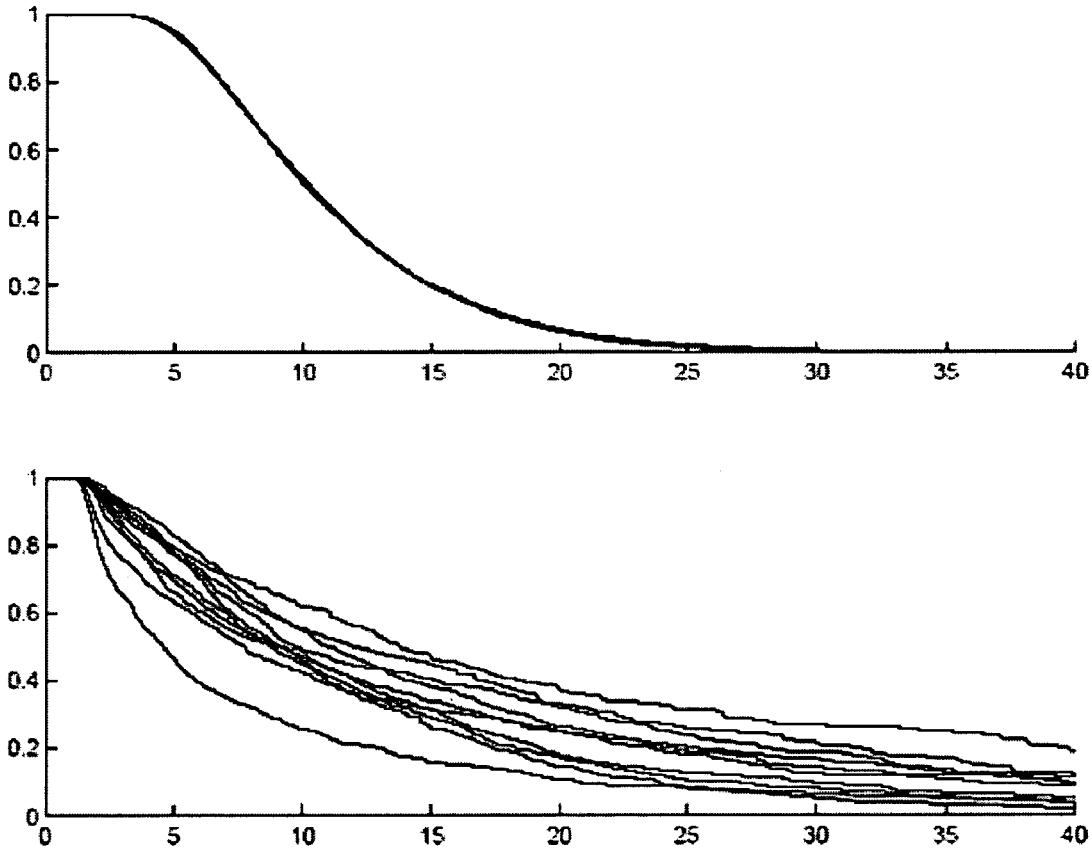
FIG. 7 shows $E_*$ for uncorrelated random processes and segments of speech signals.

Note that even very low energy paths could have in principle a high embedding index. Still, the energy concentration in paths that have very high index tends to be large for speech signals. To see that, for a given signal X, let $$E_X(t) = \frac{\sum \{|\mathcal{F}X_\gamma|_2 \, such that \, I^{svd}(\mathcal{F}X_\gamma) > t\}}{\sum |\mathcal{F}X_\gamma|_2}, \tag{9}$$

be the fraction of the total energy contained in paths with index above x. FIG. 7 shows $E_*$, as defined in equation (8) for: a) the uncorrelated random processes in FIG. 6*a*; b) the segments of speech signals in FIG. 6*b*. It can be seen in FIG. 7 that the amount of energy contained in paths with a high index value is significantly larger for speech signals than for noise distributions.

More particularly, the fraction of the total energy of the paths carried by paths with $I^{svd}>T_0$ is on average 0.005 for the noise distributions and 0.15 for the speech signals, or an increase by a factor of 30.

It seems therefore that $I^{svd}$, with the current choice of parameters, is quite effective in separating a subset of paths that are likely to be generated by speech signals. Note moreover, that similar results may be obtained with local modifications of p, τ and d. This suggests an intrinsic robustness of the separation with respect of the parameters.

This separation ability could be due, in principle, only to the very nice properties of speech signals. Note that if, for some $\mathcal{F}X_\gamma$, $I^{svd}=\infty$, then the state realization of the time series $\mathcal{F}X_\gamma$ is embedded in a subspace of $R^d$ and therefore each point of $\mathcal{F}X_\gamma$ must be described as a linear function of the delay coordinates. This condition is very restrictive on the dynamics of $\mathcal{F}X_\gamma$, but vocal emissions are locally periodic signals, and so they do fall, at least locally, into the class of linearly predictable discrete models, i.e., processes for which $X_k=r(X_{k-1}, \ldots, X_{k-d})$ for some linear function r and for some integer d.

The complexity of these linear models increases with increasing values of the embedding dimension d. But, this is not fully satisfactory as it would be desirable to be able to use the embedding index $I^{svd}$ to denoise more complex dynamics that cannot be described by simple linear predictive models.

In many cases, for small τ, what is being measured is smoothness of the path and local correlation with the embedding index. Yet, if τ is chosen as large as possible with still a clear separation of the training sets, differences that are not accounted for by local correlation may be seen. Indeed, the embedding image is squeezed along the diagonal for paths with high local smoothness. But in principle, for complex dynamics the principal direction could be oriented in any direction and therefore the embedding index is more than simply a measure of local smoothness.

There is a literature on possible ways to distinguish complex dynamical systems from random behavior (see for example, see the articles collected in [Me]). As underlined in the previous section, much of this work stresses the identification of the proper embedding parameters τ and d. A contribution of the present invention is the use of embedding techniques in the context of computational harmonic analysis. This context frees one from the need to use embedding techniques to find an effective modelization of signals. Such 'blind' use of the embedding theorem is fertile from a practical point of view, as well as a theoretical one.

Note in any case, that if the dimension of the invariant set A is $d_A=0$, then for any white noise process W, X+W has spherically symmetric embedding image and $$\frac{\sigma_1}{\sigma_d} \approx 1$$

or any embedding dimension d as in the case of pure white noise. This means that an estimator based on $I^{svd}$ is not able to estimate noisy constant time series on a given path γ. This restriction can be eased by allowing information on the distance of the center of mass of the embedding image to be included in the definition of the embedding threshold estimator.

For simplicity, it is being assumed that $d_A>0$ for all paths in $C_p$. That seems to be sufficient in analyzing speech signals.

Attenuated Embedding Estimators

In this section, a possible algorithm based on these ideas is developed. The notion of a semilocal estimator is slightly expanded to improve the actual performance of the estimator itself. To this extent, tubular neighborhoods for each atom in the windowed Fourier frame is defined, i.e.:

$$O(g_{m,l})=\{g_{m',l'} s.t. |l'-l|\leqq 1, |m'-m|\geqq 1\}, \tag{10}$$

Such neighborhoods are used in the algorithm as a way to make a decision on the value of the coefficients in a two dimensional neighborhood of $\mathcal{F}X_\gamma$ based on the analysis of the one dimensional time series $\mathcal{F}X_\gamma$ itself.

(C1) Set $\mathcal{F}=0$.

(C2) Given X, choose q>0 and expand X in a windowed Fourier frame with window size q.

(C3) Choose sampling intervals $S_l$ for time coordinate and $S_m$ for the frequency coordinate. Choose the path length p. Build a collection of paths $C_p$ as in (5).

(C4) Choose embedding dimension d and delay τ along the path. Compute the index $I^{svd}(\mathcal{F}X_{\gamma_{m,l}})$ for each $\mathcal{F}X_{\gamma_{m,l}} \in O_p$. Use (A) to find the threshold level T.

(C5) Choose attenuation coefficient α. Set $\mathcal{F}Y[m,l]=\alpha\mathcal{F}X[m,l]$ if $I^{svd}(\mathcal{F}X_\gamma)\geqq T$ for some γ containing $g_{m',l'}$, $g_{m',l'} \in O(g_{m,l})$, otherwise set $\mathcal{F}Y[m,l]=0$ if $I^{svd}(\mathcal{F}X_\gamma)<T$ for all γ containing $g_{m',l'}$, $g_{m',l'} \in O(g_{m,l})$.

(C6) Let Y be the inversion of $\mathcal{F}Y$. Set $\mathcal{F}=\mathcal{F}+Y$ and $X=X-Y$.

(C7) Choose a parameter ε>0, if |Y|>ε go to step (C2).

Note that the details of the implementation (C1)-(C7) are in line with the general strategy of matching pursuit. The window length q in step (C2) could change from one iteration to the next to 'extract' possible structure belonging to the underlining signal at several different scales. In the experiments performed in the following section alternate between the two window sizes $q_1$ and $q_2$.

The attenuation introduced in (C5) has some additional ad hoc parameters in the definition of the neighborhoods in (10) and in the choice of the attenuation parameter $\alpha$. By the double process of increasing the number of nonzero coefficients chosen at each step and decreasing their contribution, more information to be taken at each iteration of the projection pursuit algorithm is being allowed. But in a slow learning framework, that in principle (and in practice), should increase the sharpness of the distinct features of the estimate. On the general issue of attenuated learning processes, see the discussion in [HTF] chapter 10. Note that the attenuation coefficient leads to improved results only when it is part of a recursive algorithm, otherwise it gives only a rescaled version of the estimate.

One drawback of the algorithm described is the need to choose several parameters: a dictionary of analysis D; a collection of discrete paths $C_p$; the embedding parameters $\tau$ (time delay) and d (embedding dimension); and the learning parameters T (threshold level), $\alpha$ (attenuation coefficient) and $\epsilon$. Again, all such choices may be context dependent, and may be a price to pay to have an estimator that is relatively intensity independent and applicable to wide classes of noise distributions.

The choice of D may be dependent on the type of signals analyzed and there may not be a serious need to make such a choice automatic.

Since, for the case of speech signals where windowed Fourier frames are used; the algorithm is not likely to be very sensitive to the choice of the length q of the window, while the use of several windows is likely to be beneficial.

The choice of $C_p$ may also be dependent on the type of signals analyzed. Speech signals have specific frequencies that change in time, so a set of paths parallel to the time axis may be natural in this case. The relation of parameters associated with $C_p$ embedding parameters $\tau$ and d and threshold T will now be explored. Recall that for the collection $C_p$, there time and frequency sampling rates $\bar{l}$ and $\bar{m}$ and the length p of the paths as parameters. The frequency sampling rates $\bar{l}$ and $\bar{m}$ may only be necessary to speed up the algorithm. A dense sampling would be advantageous. Same considerations apply to the 'thickening' of the paths in (10). It may be possible to speed up the algorithm by collecting more data at each iteration. So, the only essential parameters may be the path length p, the embedding parameters and the threshold T. Essentially, it would be nice to set these parameters so that the number of paths that have index $I^{svd}>T$ is sizeable for a training set of speech signals and marginal for the white noise time series of interest.

Such a choice may be possible and robust. A simple rule to find the threshold T was given in step (A) in the previous section given a choice of (p, $\tau$, d). A learning algorithm could be built to find T, the paths' length p, and the embedding parameters, namely let $\overline{Q}_S(x)$ be the mean of the functions $Q_{S_i}(x)$ for a training set of speech signals $S_i$ and $\overline{Q}_W(x)$ be the mean of the functions $Q_{W_i}(x)$ for a set of white noise time series $W_i$.

First, one can find d, $\tau$ and p such that the distance of the functions $\overline{Q}_W(x)$ and $\overline{Q}_S(x)$ is maximum in the $L^2$ norm. After finding these parameters, one can find a value of T such that T is the smallest positive number with $\overline{Q}_S(T)$ one order of magnitude larger than $\overline{Q}_W(T)$, as was done in (A) in the previous section.

Finally, the choice of $\alpha$ and $\epsilon$ is completely practical in nature. Ideally, what is wanted is $\alpha$ and $\epsilon$ as close to zero as possible. But, to avoid making the algorithm unreasonably slow, one must set values that are found to give good quality reconstructions on some training set of speech signals while they require a number of iterations of the algorithm that is compatible with the computing and time requirements of the specific problem. For longer time series, as the ones in the next section, the data may be segmented into several shorter pieces, and the algorithm iterated a fixed number of times k rather than using $\epsilon$ in (C7) to decide the number of iterations.

Denoising

This section explores the quality of the attenuated embedding threshold as implemented in the an embodiment with a windowed Fourier frame and with the class of paths $C_p$. The algorithm was applied to 10 speech signals from the TIMIT database contaminated by different types of white noise with several intensity levels. It is shown that the attenuated embedding threshold estimator performs well for all white noise contaminations considered.

The delay along the paths was chosen as $\tau=4$, the length of the paths is $p=2^8$ and the window length of the windowed Fourier transform alternates between $l_1=100$ and $l_1=25$ (to detect both features with good time localization and those with good frequency localization), the embedding dimension d=4. For these parameters and for the set of speech signals used as training, $T\approx 26.8$ when $l_1=100$ and $T=27.4$ when $l_1=25$ using the procedure (A) of the "Embedding Index of Speech Signals and Random Processes" section.

The sampling interval of the paths in the frequency direction is $S_{\bar{m}}=3$ and along the time direction is $S_{\bar{l}}=p/2$. Select is $\alpha=0.1$, as small values of $\alpha$ seem to work best (see discussion in the previous section). The algorithm was applied to short consecutive speech segments to reduce the computational cost of computing the windowed Fourier transform on very long time series. Therefore, to keep the running time uniformly constant for all such segments, the algorithm (C1)-(C6) was iterated a fixed number of times (say 6 times) instead of choosing a parameter $\epsilon$ in (C7).

The window size q in (C2) alternates between $q_1=100$ and $q_2=25$. It is moreover important to note that the attenuated embedding threshold is able to extract only a small fraction of the total energy of the signal f, exactly because of the attenuation process. Therefore, the Signal-to-Noise Ratio (SNR) computations are done on scaled measurements X, estimates $\bar{F}$, and signals F set to be all of norm 1. Such estimations are called scaled SNR, and are explicitly written for a given signal F and estimation Z as:

$$SNR_s(Z) = 10\log_{10}\frac{1}{E(|F/|F|-Z/|Z|)}$$

Then, the $SNR_s(X)$ and $SNR_s(\bar{F})$ are computed by approximating the expected values $E(|F/|F|-X/|X|)$ and $E(|F/|F|-\bar{F}/|\bar{F}|)$ with an average over several realizations for each white noise contamination.

Figure 8:
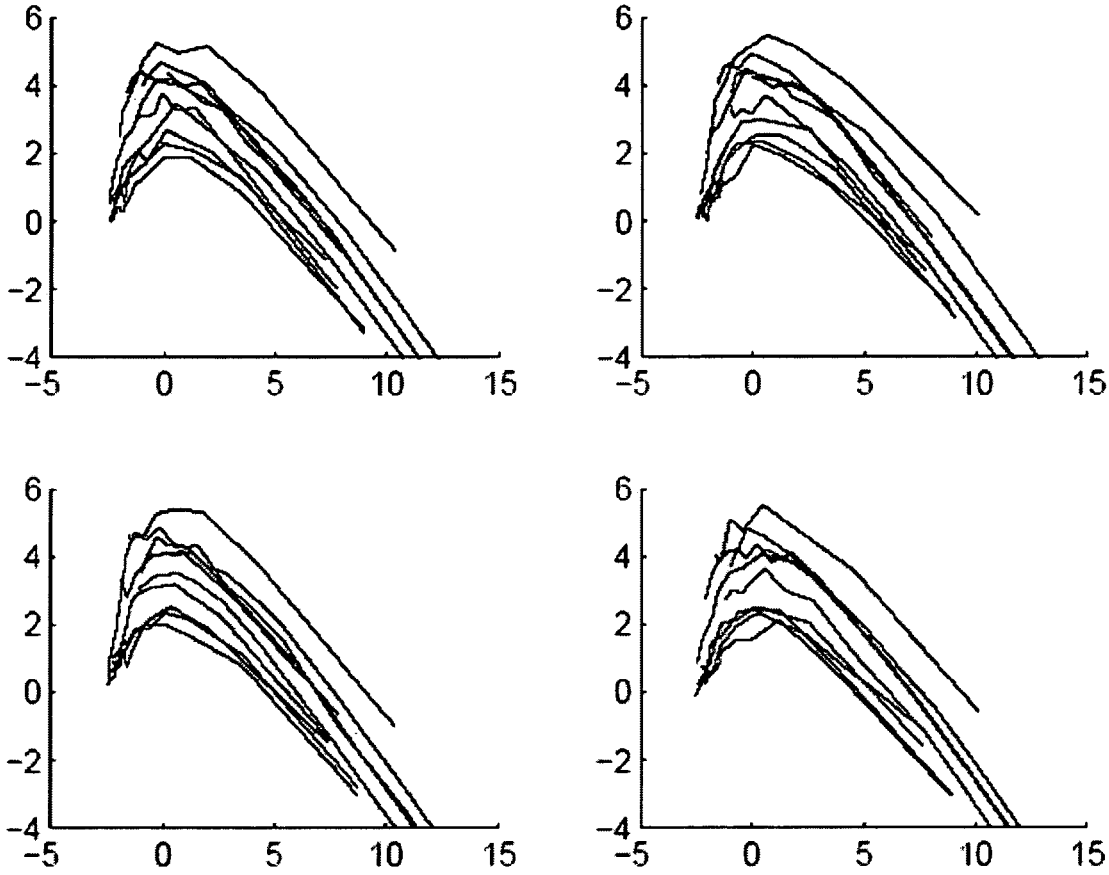
FIG. 8 shows the gains of a scaled SNR of reconstructions plotted against a corresponding scaled SNR of original measurements.

FIG. 8 shows the gains of the scaled SNR of the reconstructions (with the attenuated embedding threshold estimator) plotted against the corresponding scaled SNR of the measurements. Each curve corresponds to one of 10 speech signals of approximately one second used to test the algorithm. From top left in clockwise direction are measurements contaminated by random processes of: a) Gaussian white noise; b) uniform noise; c) Tukey white noise; and d) discrete bimodal distribution. Scaled SNR gain in decibel of the attenuated embedding estimates are plotted against the scaled SNR of the corresponding measurements. Note that the overall shape of the scaled SNR gain is similar for all distributions (notwithstanding that the discrete plots do not have exactly the same domain). The maximum gain seems to happen for measurements with scaled SNR around 1 decibel. Note that the right tail of the SNR gains often takes negative values; this is due to the attenuation effect of the estimator that is pronounced for the high intensity speech features, but it is not necessarily indicative of worse perceptual quality with respect to the measurements. Some of the figures in the following will clarify this point.

Figure 9:
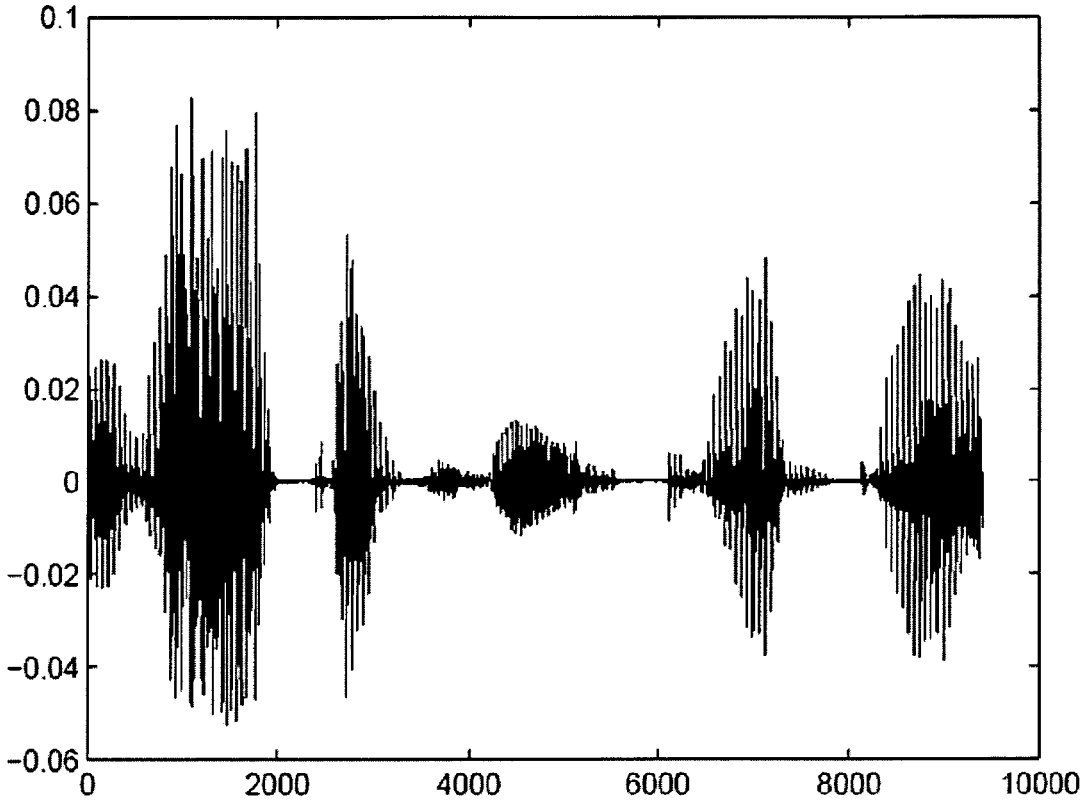
FIG. 9 shows one original speech signal.
Figure 10:
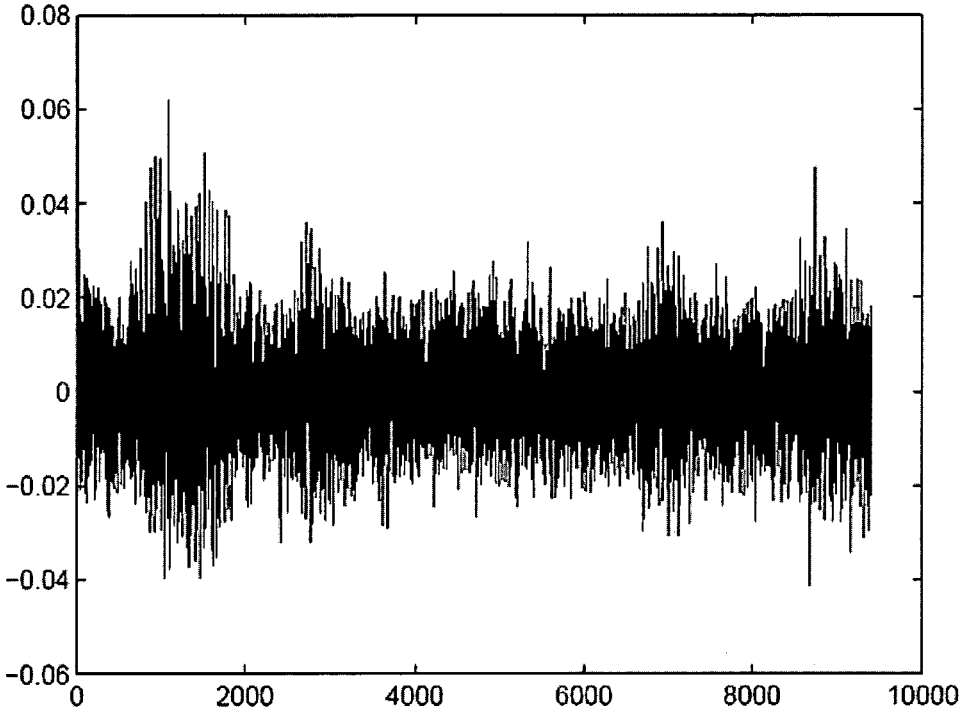
FIG. 10 shows a measurement in the presence of Gaussian noise corresponding to the 'peak' of the $SNR_s$ gain curve (measurement $SNR_s \approx 1$).
Figure 11:
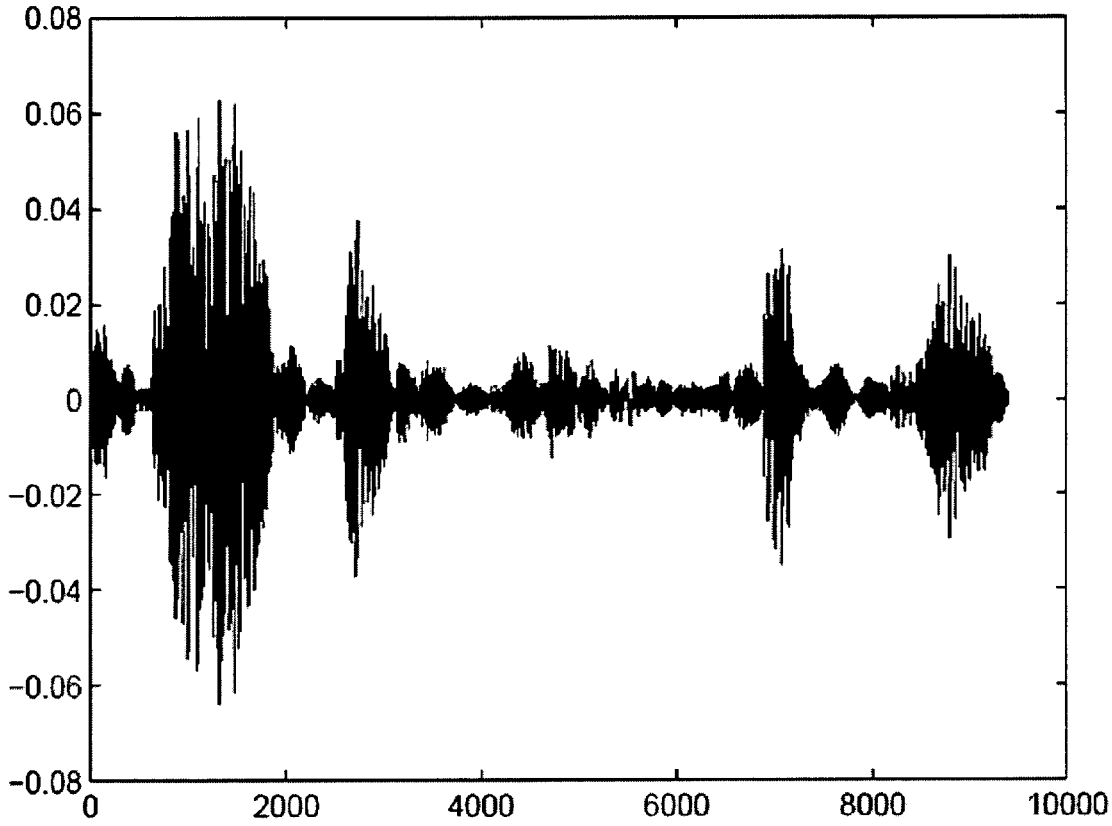
FIG. 11 shows a corresponding reconstruction with an attenuated embedding threshold estimator.
Figure 12:
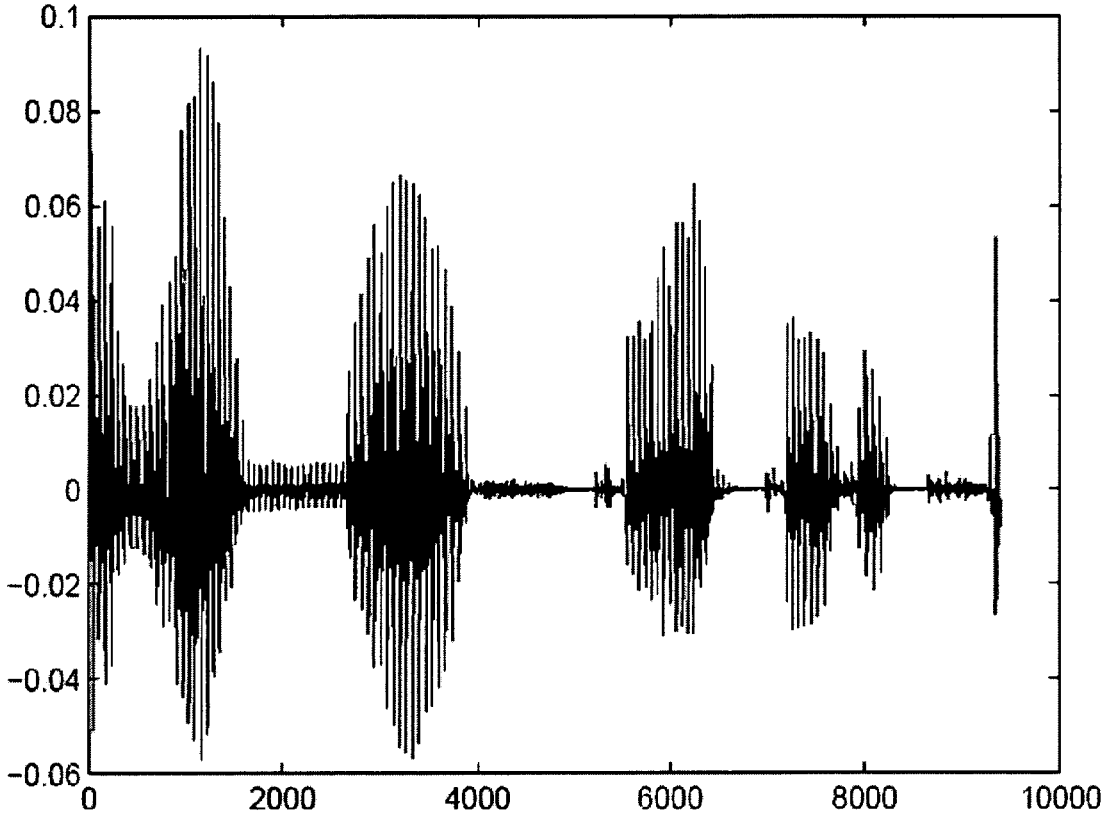
FIG. 12 shows a second speech signal
Figure 13:
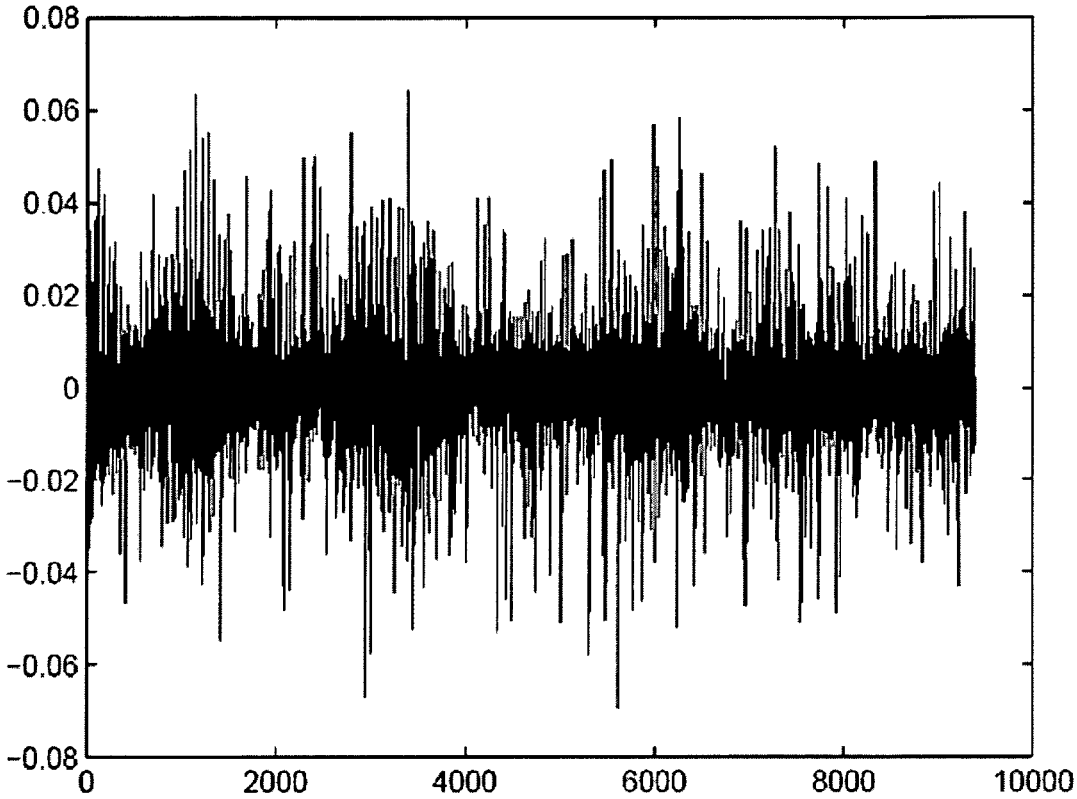
FIG. 13 shows a measurement with Tukey noise corresponding to the 'peak' of the Tukey noise $SNR_s$ gain curve (measurement $SNR_s \approx 1$)
Figure 14:
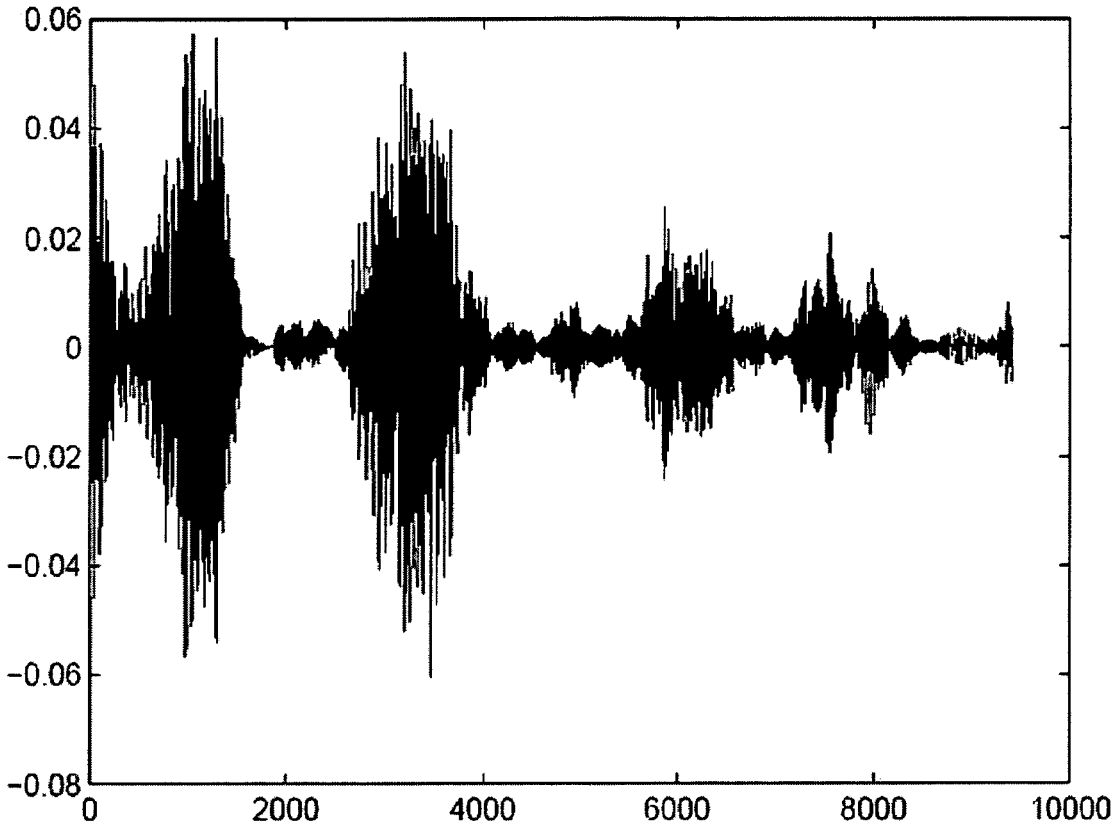
FIG. 14 shows a second reconstruction.
Figure 15:
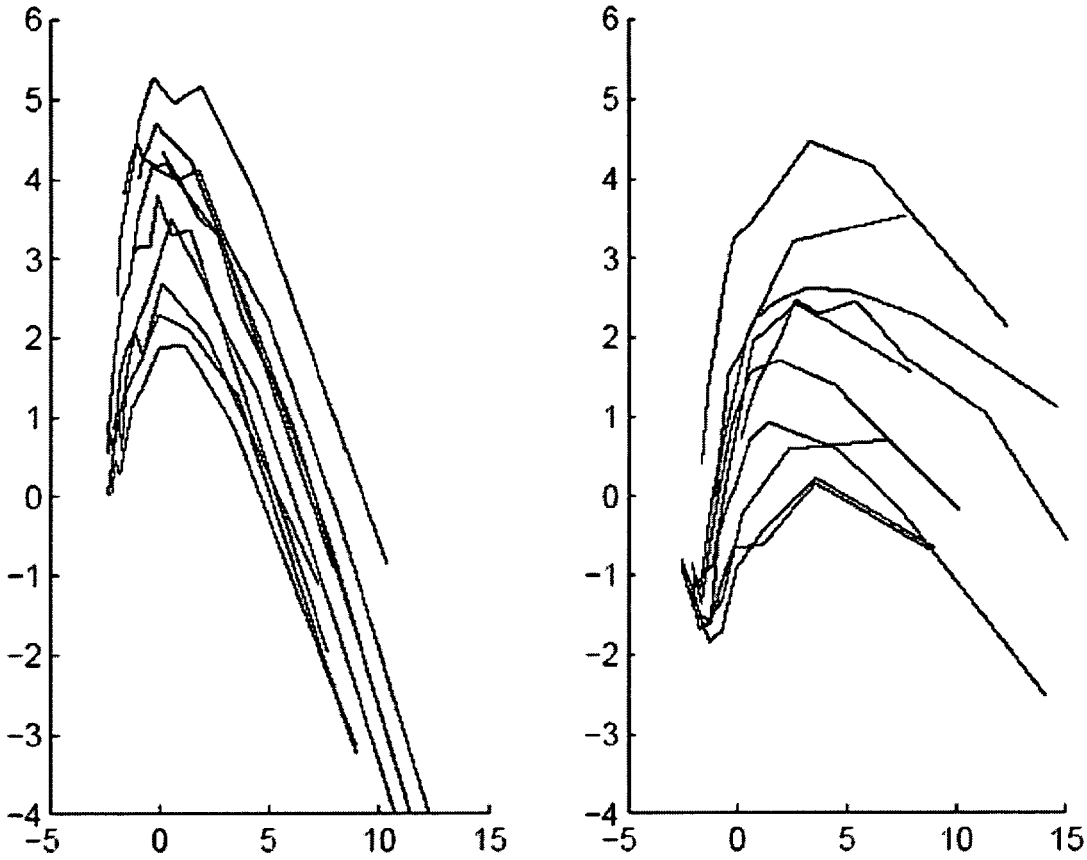
FIG. 15 shows the scaled SNR gain for tested speech signals using the block threshold estimator (right plot) and attenuated embedding estimator (left plot).
Figure 16:
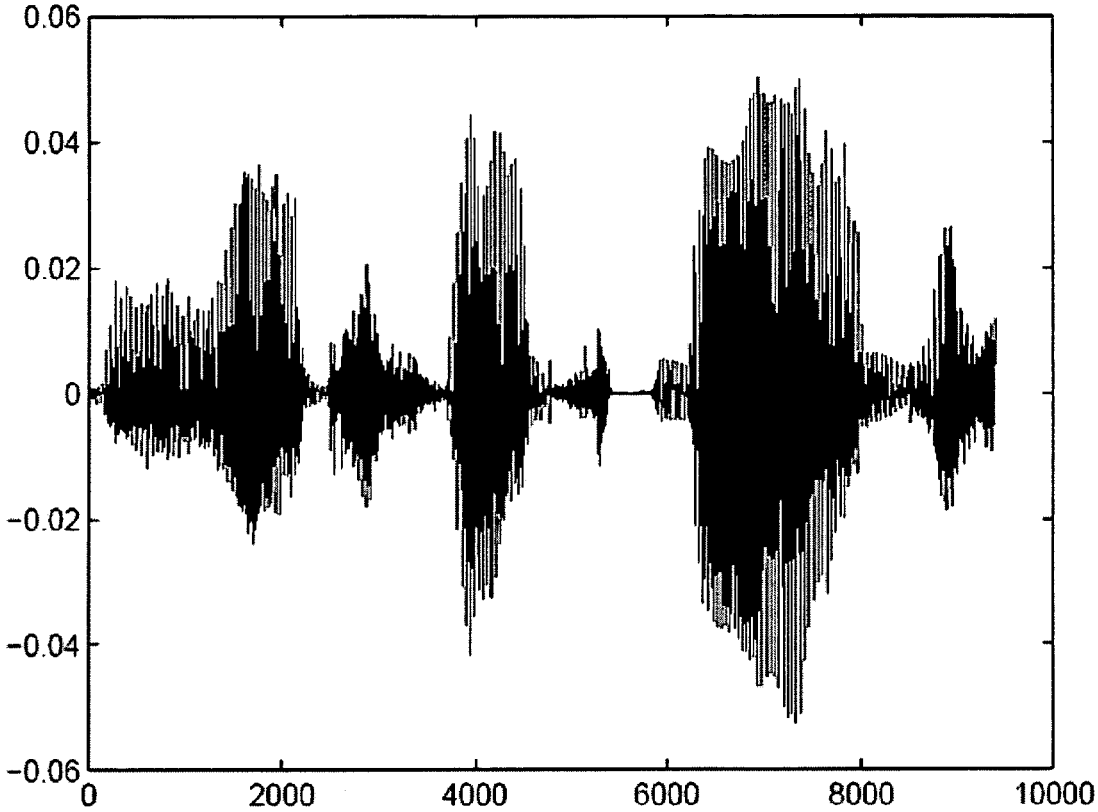
FIG. 16 shows Signal SPEECH2' scaled to have norm 1.
Figure 17:
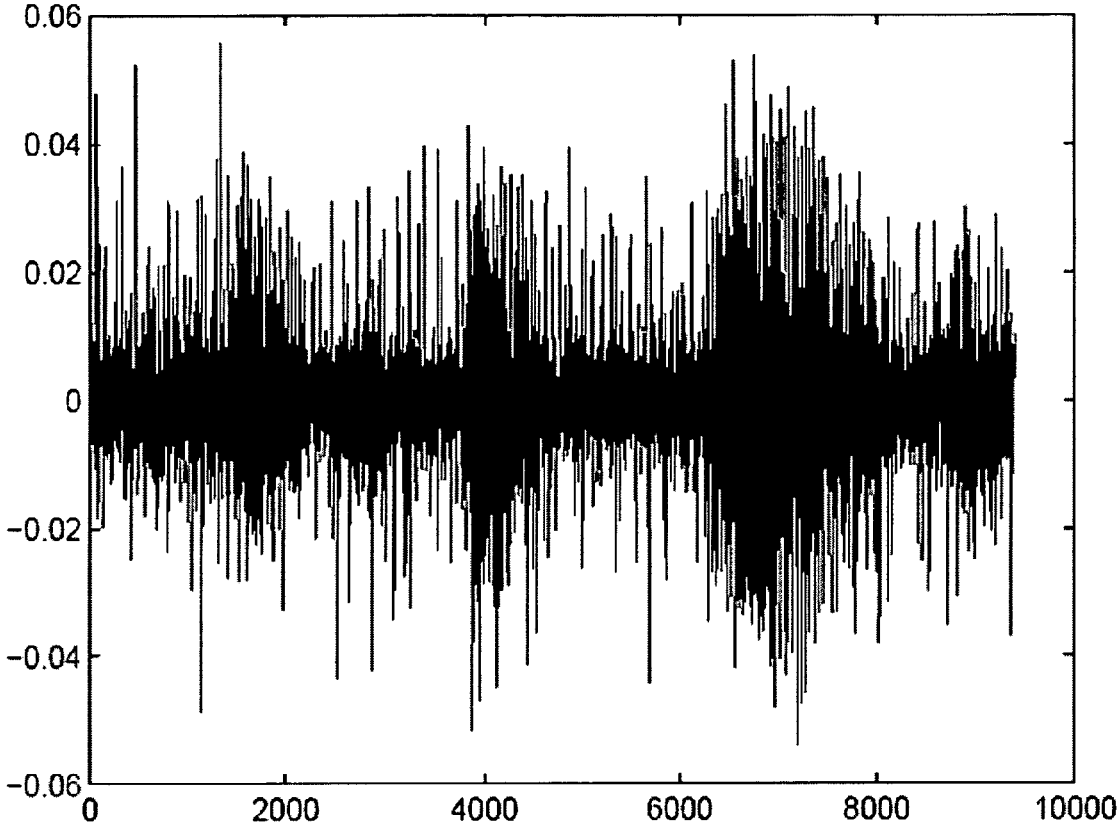
FIG. 17 shows a Noisy measurement of SPEECH2 with Tukey white noise and scaled SNR of about 4.4 db.
Figure 18:
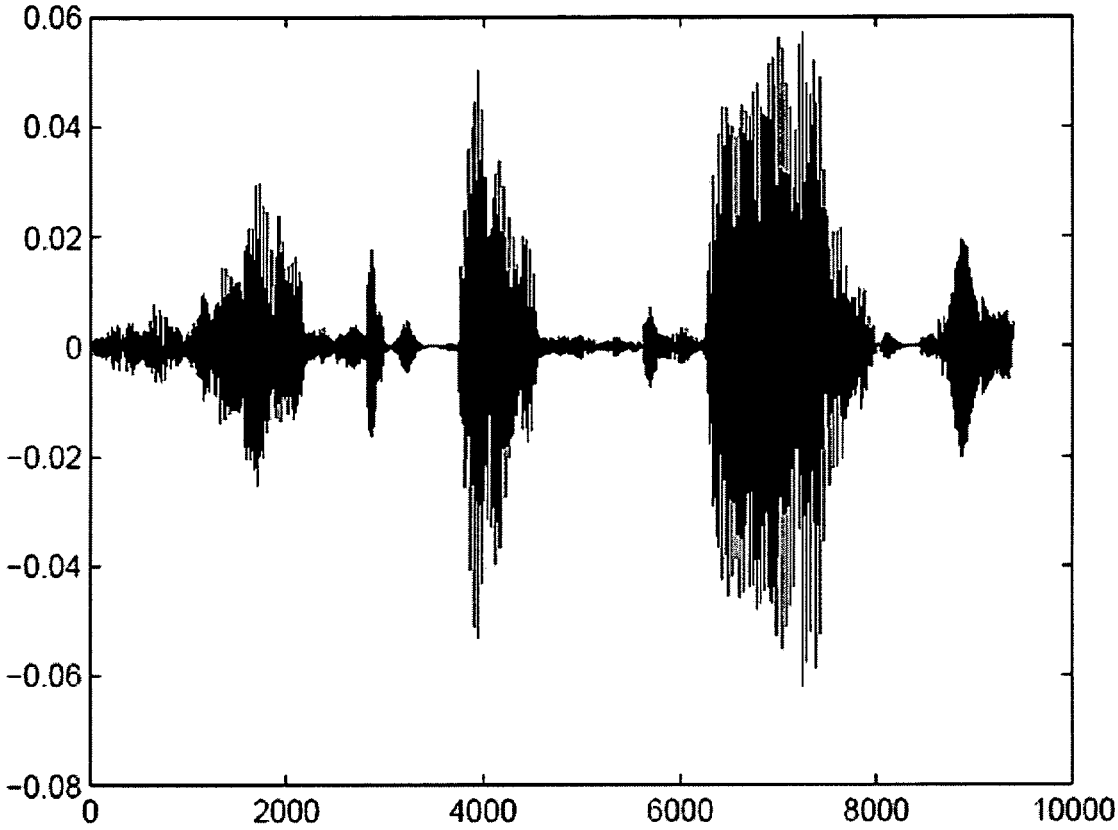
FIG. 18 shows an attenuated embedding estimate of SPEECH2 from the measurement in FIG. 12, scaled to have norm 1, $SNR_s$ is ≈8.1 db.
Figure 19:
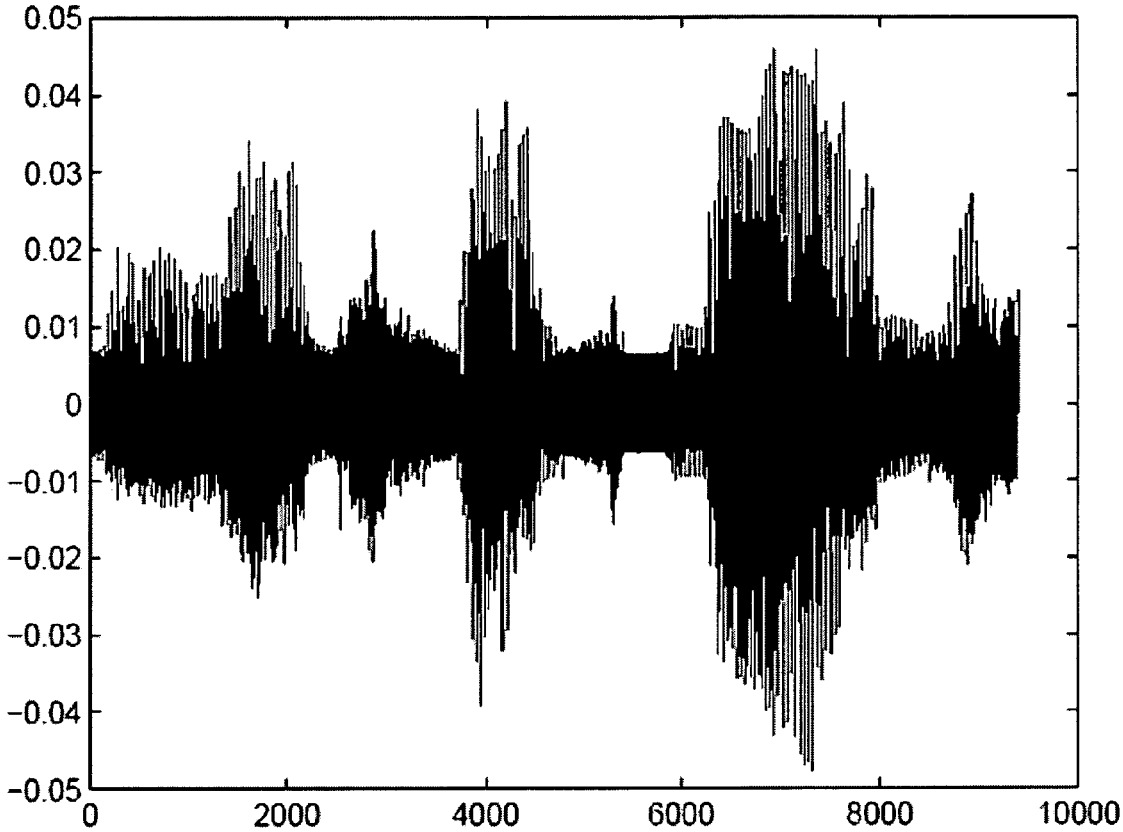
FIG. 19 shows a noisy measurement of SPEECH2 with bimodal white noise and scaled SNR of about 4.5 db.
Figure 20:
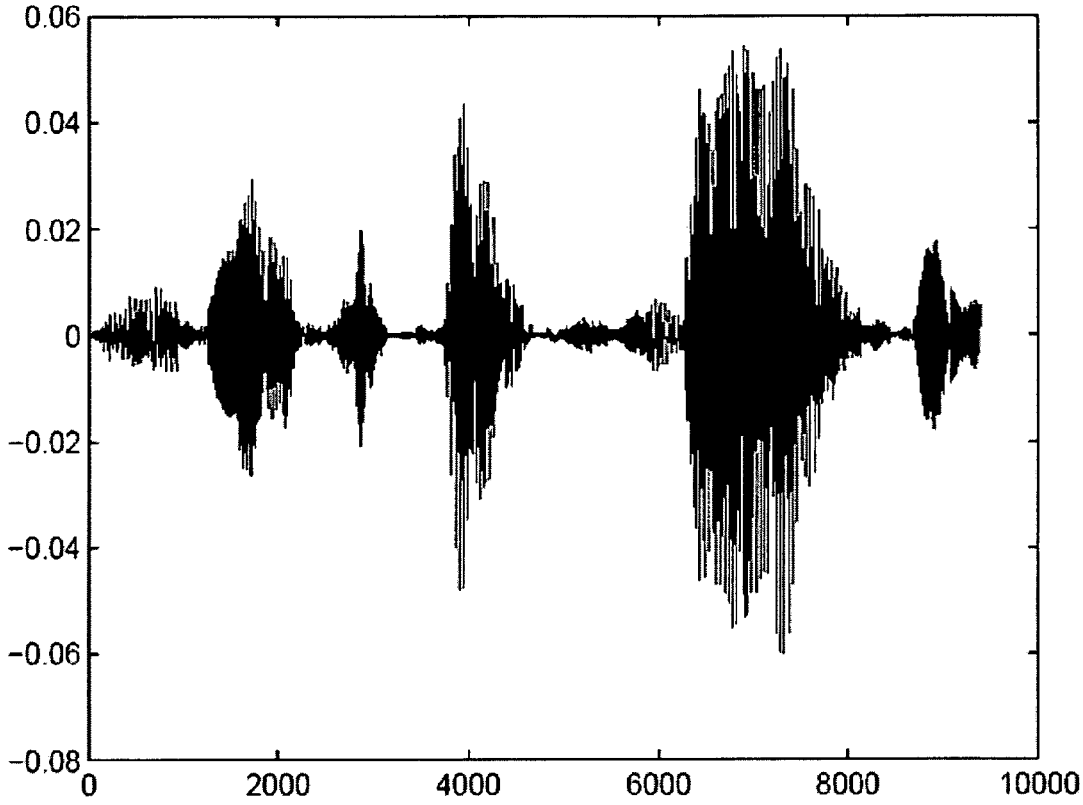
FIG. 20 shows an attenuated embedding estimate of SPEECH2 from the measurement in FIG. 14, scaled to have norm 1, $SNR_s$ is ≈8.1 db.
Figure 21:
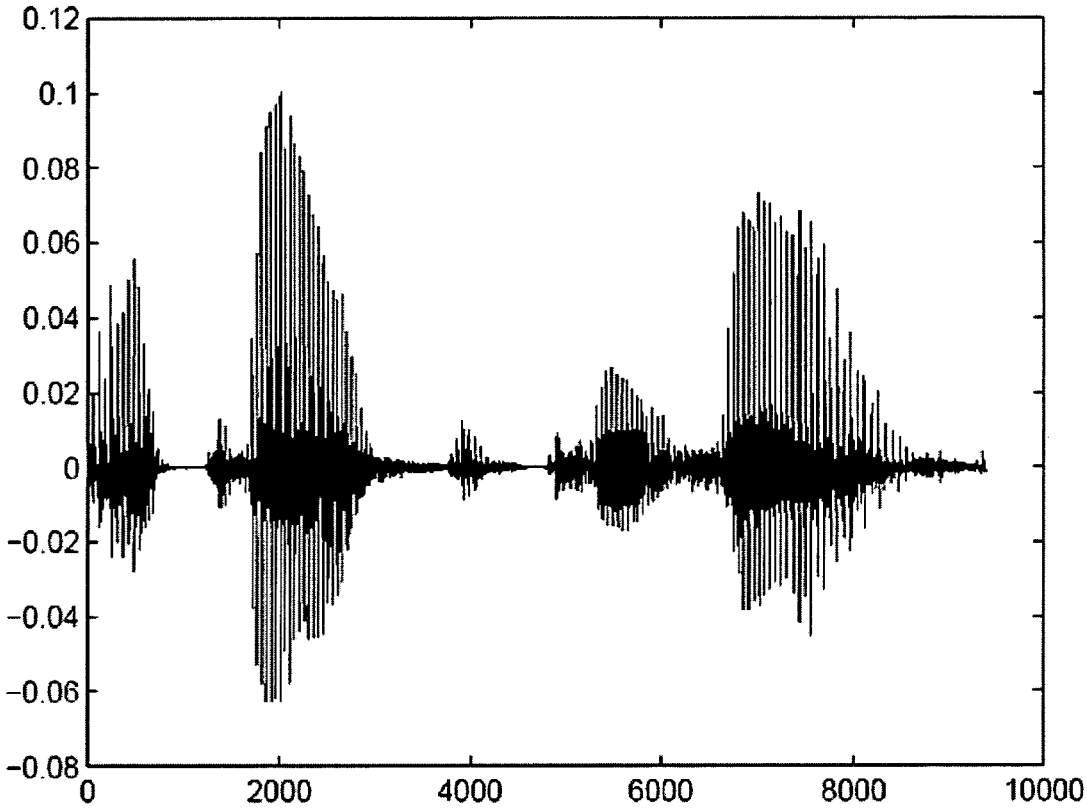
FIG. 21 shows signal 'SPEECH7' scaled to have norm 1.
Figure 22:
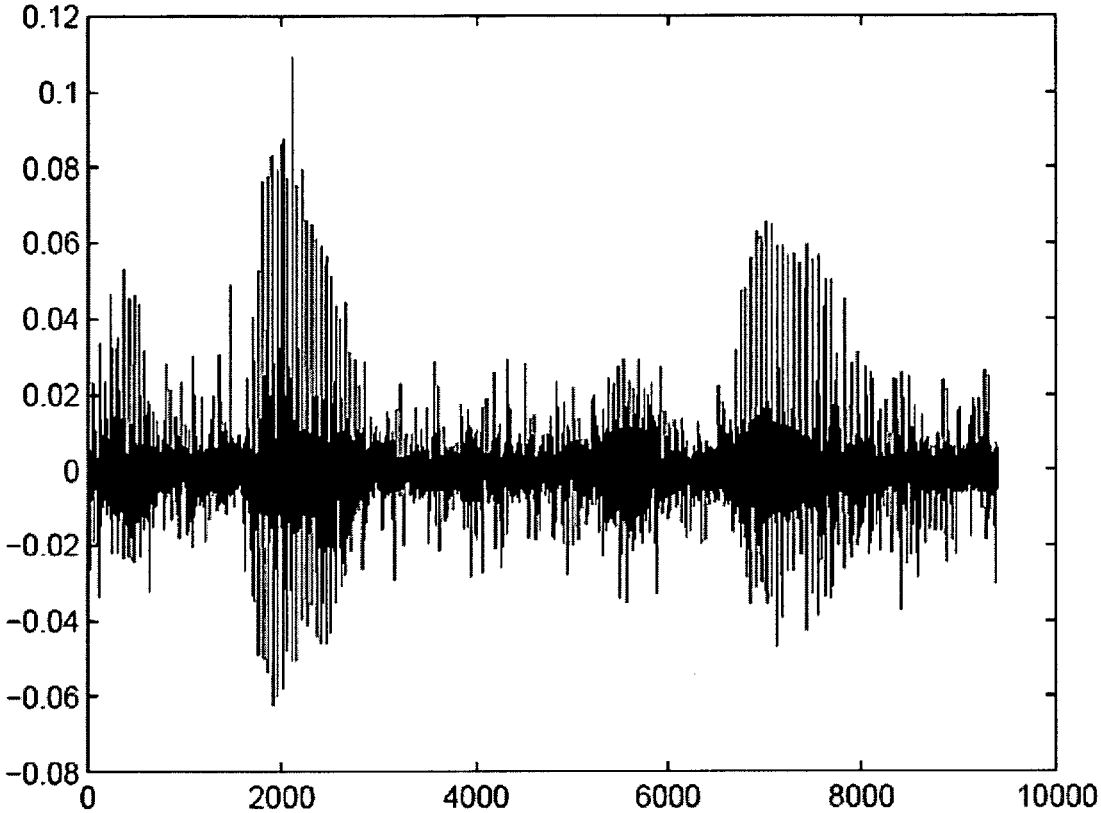
FIG. 22 shows a noisy measurement of SPEECH7 with Tukey white noise and scaled SNR of about 7.3 db.
Figure 23:
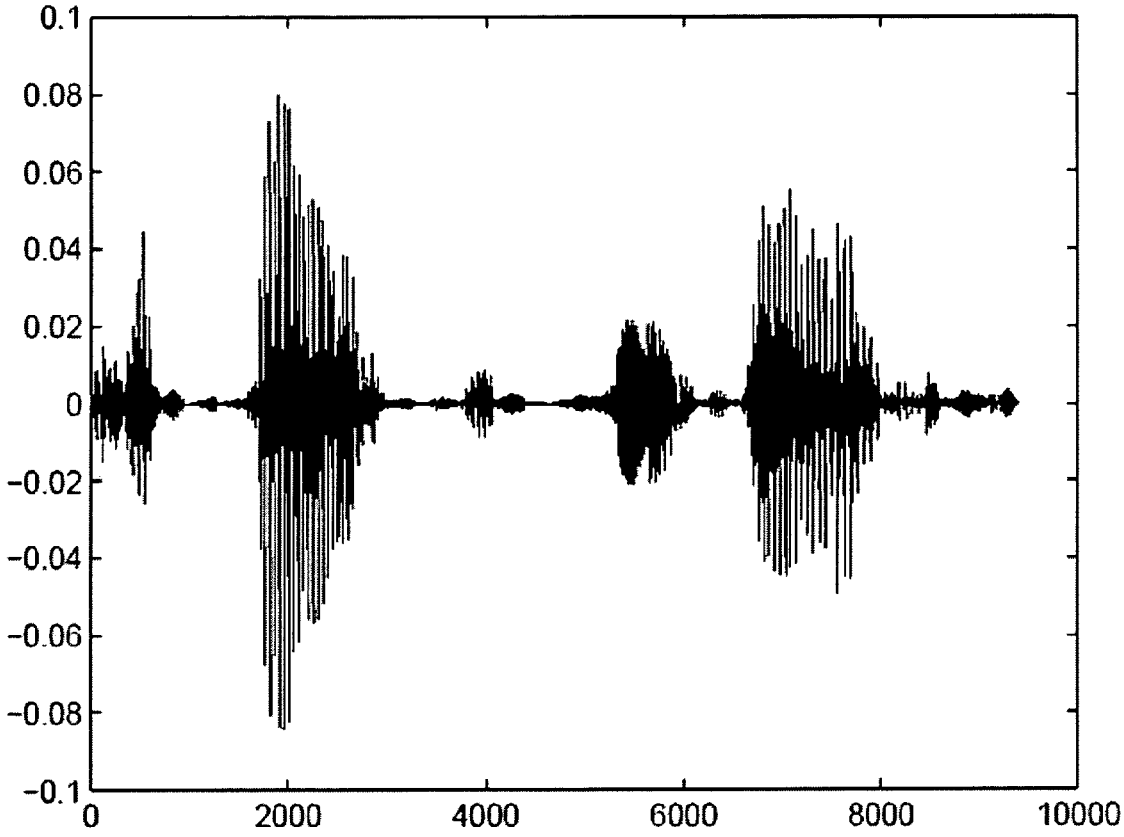
FIG. 23 shows an attenuated embedding estimate of SPEECH7 from the measurement in FIG. 17, scaled to have norm 1, $SNR_s$ is ≈6.
Figure 24:
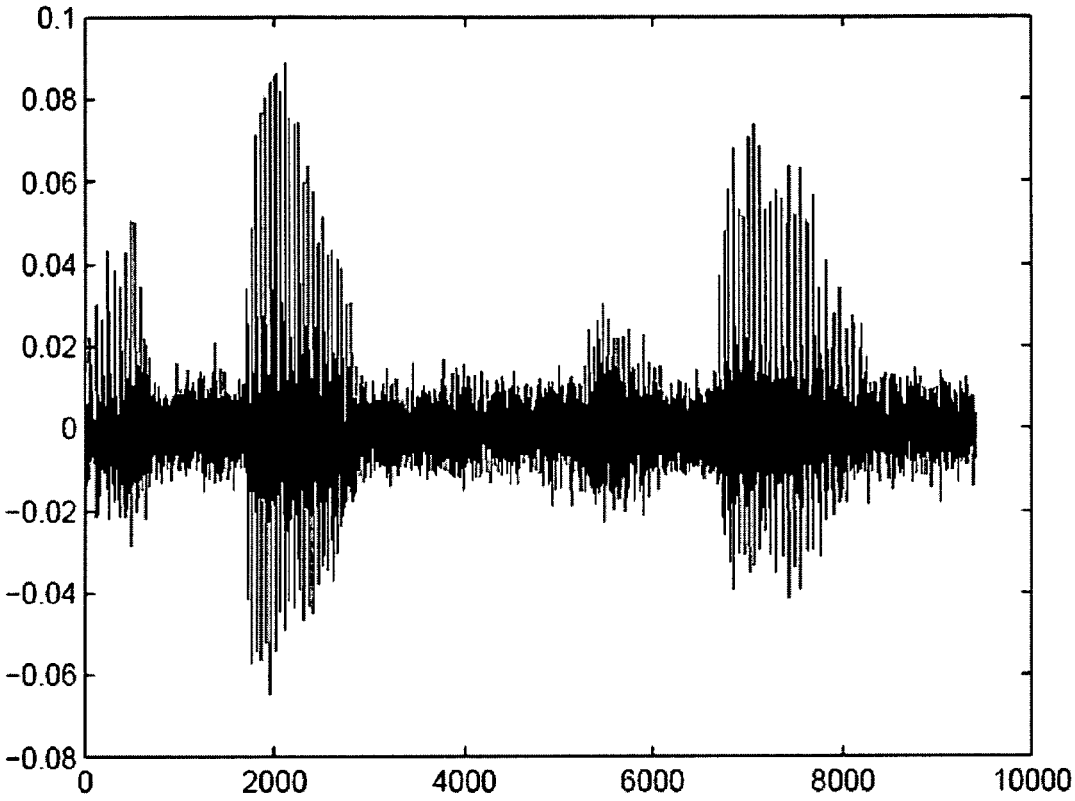
FIG. 24 shows a noisy measurement of SPEECH7 with Gaussian white noise and scaled SNR of about 11.1 db.
Figure 25:
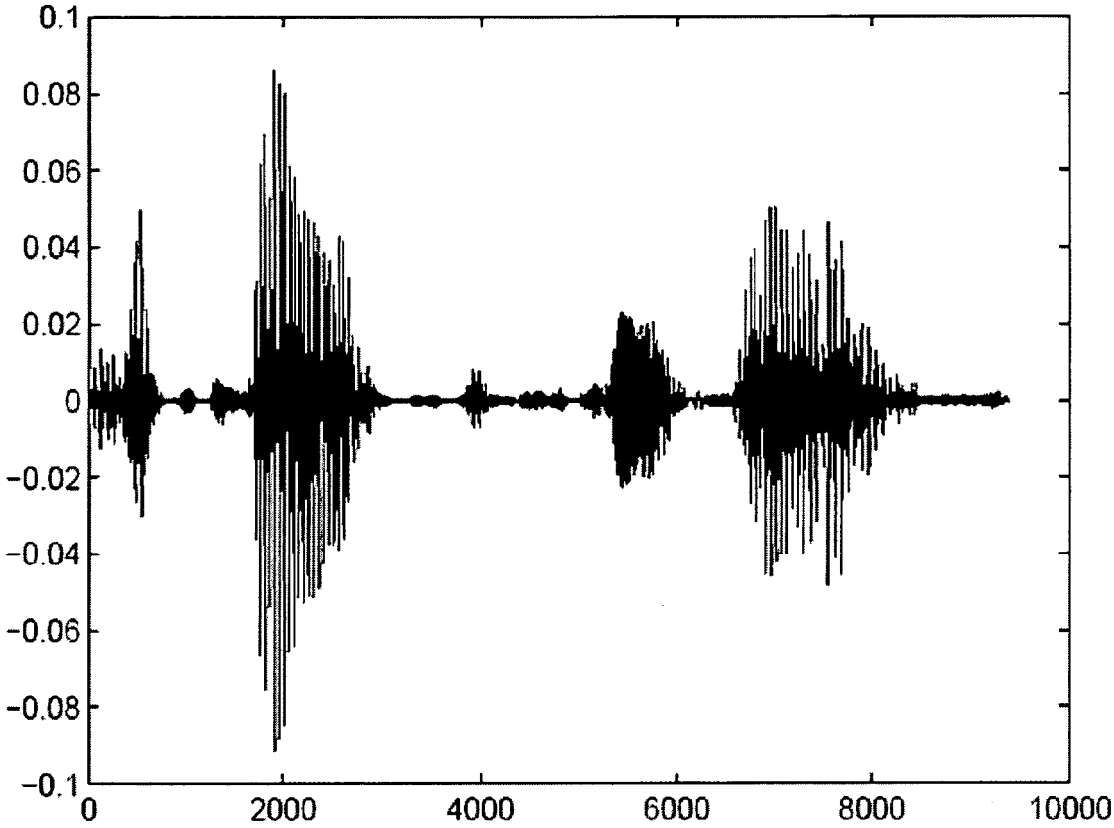
FIG. 25 shows an attenuated embedding estimate of SPEECH7 from the measurement in FIG. 19, scaled to have norm 1, $SNR_s$ is ≈7.7.
Figure 26:
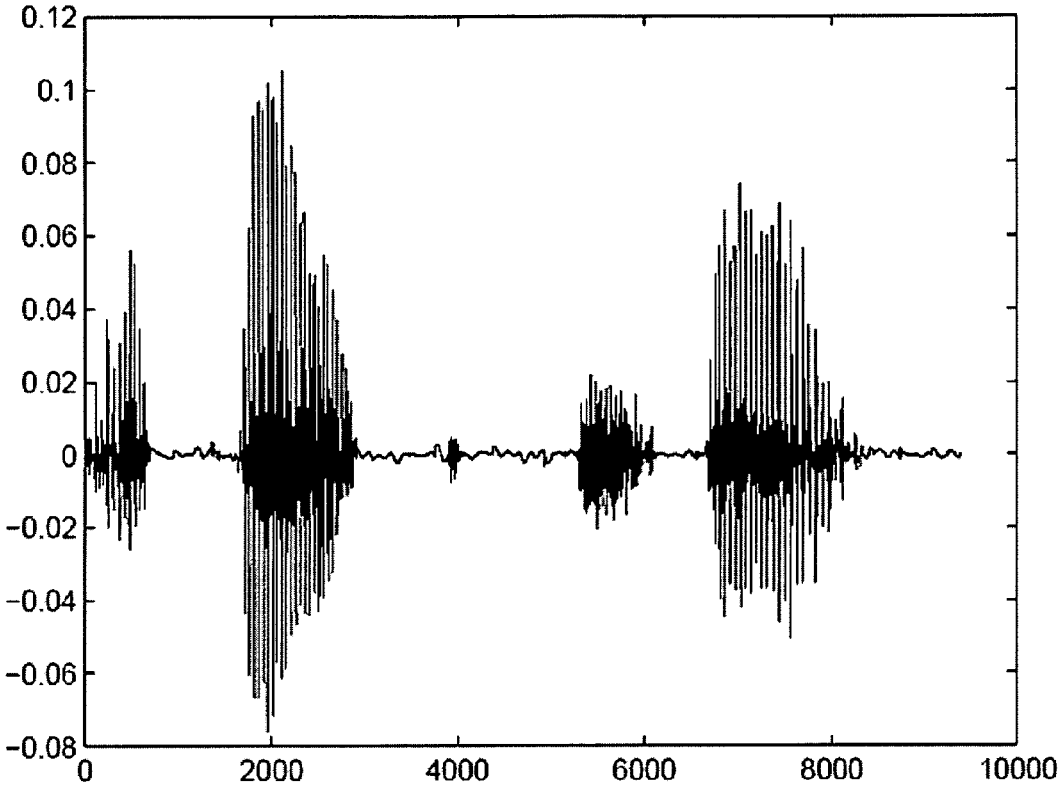
FIG. 26 shows a block thresholding estimate of SPEECH7 from the measurement in FIG. 24, scaled to have norm 1, $SNR_s$ is ≈7.6, note low intensity details are removed by the estimator.

In the first case of Gaussian white noise, the algorithm is compared to the block thresholding algorithm described in [CS]. Matlab code implemented by [ABS] is used. This code is made available at www.jstatsoft.org/v06/i06/codes/ as a part of their thorough comparison of denoising methods. As the block thresholding estimator is implemented in a symmlet wavelet basis that is not well adapted to the structure of speech signals, a more compelling comparison might require the development of an embedding threshold estimator in a wavelet basis. FIG. 15 shows the scaled SNR gain for all tested speech signals using the block threshold estimator (right plot) and attenuated embedding estimator (left plot). FIG. 9 shows one original speech signal, FIG. 10 shows the measurement in the presence of Gaussian noise corresponding to the 'peak' of the $SNR_s$ gain curve (measurement $SNR_s=1$), FIG. 11 shows the corresponding reconstruction with attenuated embedding threshold estimator. Similarly FIG. 12 shows another speech signal, while FIG. 13 shows the measurement with Tukey noise corresponding to the 'peak' of the Tukey noise $SNR_s$ gain curve (measurement $SNR_s=1$), FIG. 14 shows the reconstruction. In both cases the perceptual quality is better than the noisy measurements, which is not necessarily the case for estimators in general.

Note moreover that even though T was found using only Gaussian white noise as the training distribution, none of the parameters of the algorithm were changed from Gaussian white noise contaminations to more general white noise processes, and yet the $SNR_s$ gain was similar. It must be noted though that the estimates for bimodal and uniform noise were not intelligible at the peak of the $SNR_s$ gain curve ((just as the measurements were not).

Since the performance of the embedding estimator is not well represented by the scaled SNR for low intensity noise (measurements appear to be better than the estimates), in FIGS. 15 to 26, attempts were made to show two more instances of speech signals contaminated by lower variance Tukey noise; Gaussian noise and discrete bimodal noise (uniform noise leads to reconstructions very similar to the discrete bimodal distribution). For one case of low Gaussian white noise, a block thresholding estimate was shown. Note how the low intensity details are lost, this inability to preserve low intensity details worsen when higher variance noise is added. But then again, it may be tempered by the fact that a standard wavelet basis is not well adapted to the structure of speech signals.

Data files for the signal, measurement and reconstructions used to compute the quantities in all the figures are available upon request for direct evaluation of the perceptual quality.

Further Developments

Given that the embedding threshold ideas were implemented with the specific goal of denoising speech signals, it may be worth emphasizing that in principle the construction of class of paths can be applied to other dictionaries well adapted to other classes of signals. More particularly, let $D=\{g=1, \ldots, g_P\}$ be a generic frame dictionary of P>N elements so that $$X = \sum_{m=1}^{P} X_D[m]\tilde{g}_m,$$

$X_D[m]=\langle X,g_m\rangle$, where $\tilde{g}_m$ are dual frame vectors (see [M] ch.5). Given such a general representation for X, let $C_p\{\gamma_1, \ldots, \gamma_Q\}$, Q>P, be a collection of ordered subsets of D of length p, that is, $\gamma_i\{g_{i_1}, \ldots, g_{i_p}\}$, so that $\cup\gamma_i=D$ and the cardinality of the set $\{\gamma_i$ such that $g_j\epsilon\gamma_i\}$ is constant for every $j=0, \ldots, P-1$ (this ensures that the discrete covering of the frame atoms is locally uniform). Note that $C_p$ needs not be the entire set of ordered subsets of D. Each $\gamma_i$ may be called a 'path' in D for reasons that will be clear in the following. Let $X_{\gamma_i}=\{X_D[m]=\langle X,g_m\rangle, g_m\epsilon\gamma_i\}$ be an ordered collection of coefficients of X in the dictionary D.

Then a semi-local estimator in D can be defined as:

$$\tilde{F} = \sum_{m=0}^{P-1} d_{l,T}(X_D[m])\tilde{g}_m \tag{11}$$

where $d_{l,T}(X_D[m])=X_D[m]$ if $I(X_\gamma)\geqq T$ for some $\gamma$ containing m, and $d_{l,T}(X_D[m])=0$ if $I(X_\gamma)<T$ for all $\gamma$ containing m.

The construction of significant sets of paths $C_p$ may depend from the application. Currently being explored is the possibility of using random walks along the atoms of the dictionary D. In any case, after $C_p$ is selected, the specific choice of index $I^{svd}$ may be used and the attenuated embedding estimator may certainly be applied and tested.

On another direction, it was remarked earlier that general deterministic dynamical systems do not satisfy $I^{svd}=\infty$ for any embedding dimension d and therefore there could be $\mathcal{F}X_\gamma$ with low values of embedding index $I^{svd}$ that are mistakenly classified as uncorrelated random processes. This is in general unavoidable when dealing with finite length paths.

REFERENCES

The following references are included to provide support and enablement for this disclosure. They have been referenced at appropriate points throughout this disclosure a by bracketed abbreviations.

[ABS] A. Antoniadis, J. Bigot, T. Sapatinas, Wavelet Estimators in Nonparametric Regression: A Comparative Simulation Study, 2001, available http://www.jstatsoft.org/v06/i06/

[ASY] K. T. Alligood, T. D. Sauer, J. A. Yorke, Chaos. An introduction to Dynamical systems, Springer, 1996.

[C] T. Cai, Adaptive wavelet estimation: a block thresholding and oracle inequality approach. The Annals of Statistics 27 (1999), 898-924.

[CL] T. Cai, M. Low, Nonparametric function estimation over shrinking neighborhoods: Superefficiency and adaptation. The Annals of Statistics 33 (2005), in press.

[CS] T. Cai, B. W. Silverman, Incorporating information on neighboring coefficients into wavelet estimation, Sankhya 63 (2001), 127-148.

[DMA] G. Davis, S. Mallat and M. Avelaneda, Adaptive Greedy Approximations, Jour. of Constructive Approximation, vol. 13, No. 1, pp. 57-98,

[DJ] D. Donoho, I. Johnstone, Minimax estimation via wavelet shrinkage. Annals of Statistics 26: 879-921, 1998.

[ELPT] S. Efromovich, J. Lakey, M. C. Pereyra, N. Tymes, Data-driven and optimal denoising of a signal and recovery of its derivative using multiwavelets, IEEE transaction on Signal Processing, 52 (2004), 628-635.

[KS] H. Kantz, TSchreiber, Nonlinear Time Series Analysis, Cambridge University Press, 2003.

[HTF] T. Hastie, R. Tibshirani, J. Friedman, The Elements of Statistical Learning, Springer, 2001.

[LE] E. N. Lorenz, K. A. Emanuel, Optimal Sites for Supplementary Weather Observations Simulation with a Small Model. Journal of the Atmospheric Sciences 55, 3 (1998), 399-414.

[M] S. Mallat, A Wavelet Tour of Signal Processing, Academic Press, 1998.

[Me] A. Mees (Ed.), Nonlinear Dynamics and Statistics, Birkhauser, Boston, 2001.

[S] T. Strohmer, Numerical Algorithms for Discrete Gabor Expansions, in Gabor Analysis and Algorithms. Theory and Applications, H. G. Feichtinger, T. Strohmer editors. Birkhauser, 1998.

[SYC] T. Sauer, J. A. Yorke, M. Casdagli, Embedology, Journal of Statistical Physics, 65 (1991), 579-616.

CONCLUSIONS

The foregoing descriptions of the preferred embodiments of the present invention have been presented for purposes of illustration and description. They are not intended to be exhaustive or to limit the invention to the precise forms disclosed, and obviously many modifications and variations are possible in light of the above teaching. The illustrated embodiments were chosen and described in order to best explain the principles of the invention and its practical application to thereby enable others skilled in the art to best utilize the invention in various embodiments and with various modifications as are suited to the particular use contemplated. Although parts of the disclosure described the claimed invention being used to denoise speech signals, one skilled in the art will recognize that the claimed invention is in fact much broader. For example, the claimed invention may be used to denoise other types of signals such as: other audio signals, transducer signals, measurements from systems describable by ordinary differential equations, images, signals obtained with remote sensing devices and biological measurements.

What is claimed is:

1. A computer-readable medium encoded with a speech signal denoising computer program, wherein execution of said "speech signal denoising computer program" by one or more processors causes said "one or more processors" to perform the steps of:

a) choosing a speech signal class, said "speech signal class" being a collection of speech signals;

b) selecting at least one analysis dictionary, at least one of said "at least one analysis dictionary" used to describe said "collection of speech signals";

c) defining at least one collection of paths in at least one of said "at least one analysis dictionary" for said "speech signal class", each of said "at least one collection of paths" including at least one path;

d) initializing an estimate;

e) initializing an update speech signal with a speech signal corrupted by noise;

f) calculating said "estimate" by iteratively:

i) computing coefficients for said "update speech signal" using one of said "at least one analysis dictionary";

ii) computing an embedding index for each of said "at least one path";

iii) extracting a coefficient subset from said "coefficients" for each of said "at least one path" whose said "embedding index" exceeds an embedding threshold;

iv) adding said "coefficient subset" to a coefficient collection;

v) generating a partial estimate using said "coefficient collection";

vi) creating an attenuated partial estimate by attenuating said "partial estimate" by an attenuation factor;

vii) updating said "update speech signal" by subtracting said "attenuated partial estimate" from said "update speech signal"; and viii) adding said "attenuated partial estimate" to said "estimate".

2. A computer-readable medium according to claim 1, wherein at least one of said "at least one analysis dictionary" is a windowed Fourier frame.

3. A computer-readable medium according to claim 1, wherein at least one of said "at least one collection of paths" is a set of short lines oriented in time direction in said windowed Fourier frame.

4. A computer-readable medium according to claim 1, wherein said step of "computing an embedding index for each of said 'at least one path'" includes the steps of:

a) choosing an embedding dimension;

b) choosing an embedding delay;

c) initialize an embedding matrix, said "embedding matrix having said "embedding dimension" columns and a multitude of rows;

d) from the beginning of said "at least one path" to the end of said "at least one path", iteratively:

i) adding the current point on said "at least one path" to the current said "embedding matrix" row;

ii) for said "embedding dimension" times:

(1) advancing along said "path" by said "embedding delay"; and (2) adding the current point on said "at least one path" to the current said "embedding matrix" row;

iii) advancing one unit along said "at least one path"; and iv) advancing to the next row in said "embedding matrix";

e) computing the largest singular value of said "embedding matrix";

f) computing the smallest singular value of said "embedding matrix"; and g) computing said "embedding index" as the quotient of said "largest singular value" and said "smallest singular value".

5. A computer-readable medium according to claim 1, wherein said "embedding threshold" is calculated by:

a) for each of a multitude of signal training sets; iteratively:

i) computing said "embedding index" for each path in said "at least one collection of paths"; and ii) generating a modified cumulative distribution function for said "embedding index" for each said "at least one collection of paths";

b) for each of a multitude of noise signal training sets; iteratively:

i) computing said "embedding index" for each path in said "at least one collection of paths"; and ii) generating a said "modified cumulative distribution function" for said "embedding index" for each of said "at least one collection of paths; and c) selecting said "embedding threshold" where said "modified cumulative distribution function" for said "multitude of signal training sets" and for said "multitude of noise signal training sets" are well separated.

6. A computer-readable medium according to claim 5, wherein said "modified cumulative distribution function" is an index cumulative function.

7. A computer-readable medium according to claim 1, wherein said "modified cumulative distribution function" is a cumulative distribution function that gives the probability that said "embedding index" has a value larger than or equal to a given value.

8. A computer-readable medium according to claim 4, wherein said "embedding index" is a combination of said "embedding index" and a distance of said "embedding matrix" from an origin.

9. A computer-readable medium according to claim 1, wherein:

a) said step of "choosing a signal class" is performed prior to the encoding of said computer program; and b) said "signal class" is included in said computer program.

10. A computer-readable medium according to claim 1, wherein:

a) said step of "selecting at least one analysis dictionary" is performed prior to the encoding of said computer program; and b) at least one of said "at least one analysis dictionary" is included in said computer program.

11. A computer-readable medium according to claim 1, wherein:

a) said step of "defining at least one collection of paths" is performed prior to the encoding of said computer program; and b) at least one of said "at least one collection of paths" is included in said computer program.

12. A denoising apparatus comprising:

a) an input device configured to receive a speech signal corrupted by noise, said "speech signal" being a member of a speech signal class, said "speech signal class" being a collection of speech signals;

b) at least one analysis dictionary, at least one of said "at least one analysis dictionary" used to describe said collection of speech signals";

c) at least one collection of paths in at least one of said "at least one analysis dictionary" for said "speech signal class", each of said "at least one collection of paths" including at least one path;

d) an estimate initializer configured to initialize an estimate;

e) an update signal initializer configured to initialize an update speech signal with said "speech signal corrupted by noise";

f) an estimate calculator, said "estimate calculator" configured to calculate an estimate by iteratively:

i) computing coefficients for said "update speech signal" using one of said "at least one analysis dictionary";

ii) computing an embedding index for each of said "at least one path";

iii) extracting a coefficient subset from said "coefficients" for each of said "at least one path" whose said "embedding index" exceeds an embedding threshold;

iv) adding said "coefficient subset" to a coefficient collection;

v) generating a partial estimate using said "coefficient collection";

vi) creating an attenuated partial estimate by attenuating said "partial estimate" by an attenuation factor;

vii) updating said "update speech signal" by subtracting said "attenuated partial estimate" from said "update speech signal"; and viii) adding said "attenuated partial estimate" to said "estimate".

13. An apparatus according to claim 12, wherein at least one of said "at least one analysis dictionary" is a windowed Fourier frame.

14. An apparatus according to claim 12, wherein at least one of said "at least one collection of paths" is a set of short lines oriented in time direction in said windowed Fourier frame.

15. An apparatus according to claim 12, wherein said step of "computing an embedding index for each of said 'at least one path'" includes the steps of:

a) choosing an embedding dimension;

b) choosing an embedding delay;

c) initialize an embedding matrix, said "embedding matrix having said "embedding dimension" columns and a multitude of rows;

d) from the beginning of said "at least one path" to the end of said "at least one path", iteratively:

i) adding the current point on said "at least one path" to the current said "embedding matrix" row;

ii) for said "embedding dimension" times, (1) advancing along said "path" by said "embedding delay"; and (2) adding the current point of said "at least one path" to the current said "embedding matrix" row;

iii) advancing one unit along said "at least one path"; and iv) advancing to the next row in said "embedding matrix";

e) computing the largest singular value of said "embedding matrix";

f) computing the smallest singular value of said "embedding matrix"; and g) computing said "embedding index" as the quotient of said "largest singular value" and said "smallest singular value".

16. An apparatus according to claim 12, wherein said "embedding threshold" is calculated by:

a) for each of a multitude of signal training sets, iteratively:

i) computing said "embedding index" for each path in said "at least one collection of paths"; and ii) generating a modified cumulative distribution function for said "embedding index" for each said "at least one collection of paths";

b) for each of a multitude of noise signal training sets; iteratively:

i) computing said "embedding index" for each path in said "at least one collection of paths"; and ii) generating a said "modified cumulative distribution function" for said "embedding index" for each of said "at least one collection of paths; and c) selecting said "embedding threshold" where said "modified sets" and for said "multitude of noise signal training sets" are well separated.

17. An apparatus according to claim 16, wherein said "modified cumulative distribution function" is an index cumulative function.

18. An apparatus according to claim 12, wherein said "embedding index" is a combination of said "embedding index" and a distance of said "embedding matrix" from an origin.

* * * * *